US007207642B2

(12) United States Patent
Usui

(10) Patent No.: US 7,207,642 B2
(45) Date of Patent: Apr. 24, 2007

(54) LIQUID EJECTING APPARATUS, LIQUID EJECTION METHOD, AND PRINTING SYSTEM

(75) Inventor: Toshiki Usui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 263 days.

(21) Appl. No.: 11/053,204

(22) Filed: Feb. 9, 2005

(65) Prior Publication Data

US 2005/0190218 A1 Sep. 1, 2005

(30) Foreign Application Priority Data

Feb. 9, 2004 (JP) ..... 2004-032640

(51) Int. Cl.
*B41J 29/38* (2006.01)

(52) U.S. Cl. ..... 347/17; 347/57

(58) Field of Classification Search ..... 347/17, 347/57

See application file for complete search history.

(56) References Cited

U.S. PATENT DOCUMENTS 6,293,655 B1 * 9/2001 Imanaka et al. ..... 347/65
6,880,904 B2 * 4/2005 Masuda ..... 347/5

FOREIGN PATENT DOCUMENTS

JP 2003-72058 A 3/2003

* cited by examiner

*Primary Examiner*—Thinh Nguyen
(74) *Attorney, Agent, or Firm*—Sughrue Mion, PLLC

(57) ABSTRACT

A liquid ejecting apparatus that drives an element to eject a liquid onto a medium, is provided with: a drive signal generator that is configured to generate a plurality of types of ejection drive signals for driving the element to eject the liquid; a sensor for detecting a temperature of the drive signal generator; and a controller that temporarily halts generation of the ejection drive signal from the drive signal generator based on the type of the ejection drive signal and a result of detection by the sensor.

20 Claims, 18 Drawing Sheets

FIG.12A

STANDBY CONDITIONS OF COM1

| | DETECTED TEMPERATURE | | | | |
|---|---|---|---|---|---|
| | T<-20°C | -20°C≦T<60°C | 60°C≦T<65°C | 65°C≦T<70°C | 70°C≦T |
| STANDBY TIME | STOP | 0 SECONDS | 1 SECOND | 3SECONDS | STOP |

FIG.12B

STANDBY CONDITIONS OF COM2

| | DETECTED TEMPERATURE | | | | |
|---|---|---|---|---|---|
| | T<-20°C | -20°C≦T<70°C | 70°C≦T<75°C | 75°C≦T<80°C | 80°C≦T |
| STANDBY TIME | STOP | 0 SECONDS | 0.5 SECONDS | 1.5SECONDS | STOP |

FIG.12C

STANDBY CONDITIONS OF COM3

| | DETECTED TEMPERATURE | | | | |
|---|---|---|---|---|---|
| | T<-20°C | -20°C≦T<80°C | 80°C≦T<85°C | 85°C≦T<90°C | 90°C≦T |
| STANDBY TIME | STOP | 0 SECONDS | 0.5 SECONDS | 1.5SECONDS | STOP |

FIG.17A

STANDBY CONDITIONS OF COM1

| | DETECTED TEMPERATURE | | | | |
|---|---|---|---|---|---|
| | T<-20℃ | -20℃≦T<60℃ | 60℃≦T<65℃ | 65℃≦T<70℃ | 70℃≦T |
| STANDBY TIME | STOP | 0 SECONDS | 30 SECONDS | 60 SECONDS | STOP |

FIG.17B

STANDBY CONDITIONS OF COM2

| | DETECTED TEMPERATURE | | | | |
|---|---|---|---|---|---|
| | T<-20℃ | -20℃≦T<70℃ | 70℃≦T<75℃ | 75℃≦T<80℃ | 80℃≦T |
| STANDBY TIME | STOP | 0 SECONDS | 20 SECONDS | 40 SECONDS | STOP |

FIG.17C

STANDBY CONDITIONS OF COM3

| | DETECTED TEMPERATURE | | | | |
|---|---|---|---|---|---|
| | T<-20℃ | -20℃≦T<80℃ | 80℃≦T<85℃ | 85℃≦T<90℃ | 90℃≦T |
| STANDBY TIME | STOP | 0 SECONDS | 20 SECONDS | 40 SECONDS | STOP |

FIG.19

| DRIVE SIGNAL | THRESHOLD VALUE | STANDBY TIME |
|---|---|---|
| COM1 | 65℃ | 60SECONDS |
| COM2 | 75℃ | 40SECONDS |
| COM3 | 85℃ | 40SECONDS |

LIQUID EJECTING APPARATUS, LIQUID EJECTION METHOD, AND PRINTING SYSTEM

CROSS-REFERENCE TO RELATED APPLICATIONS

The present application claims priority upon Japanese Patent Application No. 2004-32640 filed on Feb. 9, 2004, which is herein incorporated by reference.

BACKGROUND OF THE INVENTION

1. Field of the Invention

The present invention relates to liquid ejecting apparatuses, liquid ejection methods, and printing systems.

2. Description of the Related Art

Inkjet printers in which piezo elements are driven to eject ink onto paper are known. Such inkjet printers are provided with a drive signal generator that generates ejection drive signals for driving the piezo elements to cause the ejection of ink.

When an inkjet printer performs printing continuously, the drive signal generator becomes hot. When the temperature of the drive signal generator becomes elevated due to this heat, there is a possibility that the inkjet printer will break down.

Accordingly, the approach of temporarily halting the generation of ejection drive signals from the drive signal generator has been proposed (see, for example, JP 2003-72058A).

However, if the drive signal generator is configured to generate a plurality of types of ejection drive signals, then the amount of power that is consumed differs depending on the type of the ejection drive signal. Therefore, if the printer performs standby (temporary halting) in the same way for each type of ejection drive signal, then the printing speed will drop. On the other hand, adopting components to keep the printing speed from dropping increases costs. Moreover, this problem is not limited to printers, and can occur with any liquid ejecting apparatus that employs inkjet technology.

SUMMARY OF THE INVENTION

Accordingly, it is an object of the present invention to make it possible to provide a liquid ejecting apparatus that is inexpensive and that has a fast processing speed.

A primary aspect of the present invention is a liquid ejecting apparatus that drives an element to eject a liquid onto a medium, comprising: a drive signal generator that is configured to generate a plurality of types of ejection drive signals for driving the element to eject the liquid; a sensor for detecting a temperature of the drive signal generator; and a controller that temporarily halts generation of the ejection drive signal from the drive signal generator based on the type of the ejection drive signal and a result of detection by the sensor.

Other features of the present invention will become clear through the accompanying drawings and the following description.

BRIEF DESCRIPTION OF THE DRAWINGS

FIG. 12A to FIG. 12C are tables showing the standby conditions;

FIGS. 17A to 17C are tables showing the standby conditions of the other embodiment;

FIG. 19 is a table showing the relationship between the types of the ejection drive signals and the threshold value and standby time.

DETAILED DESCRIPTION OF THE INVENTION

Figure 1:
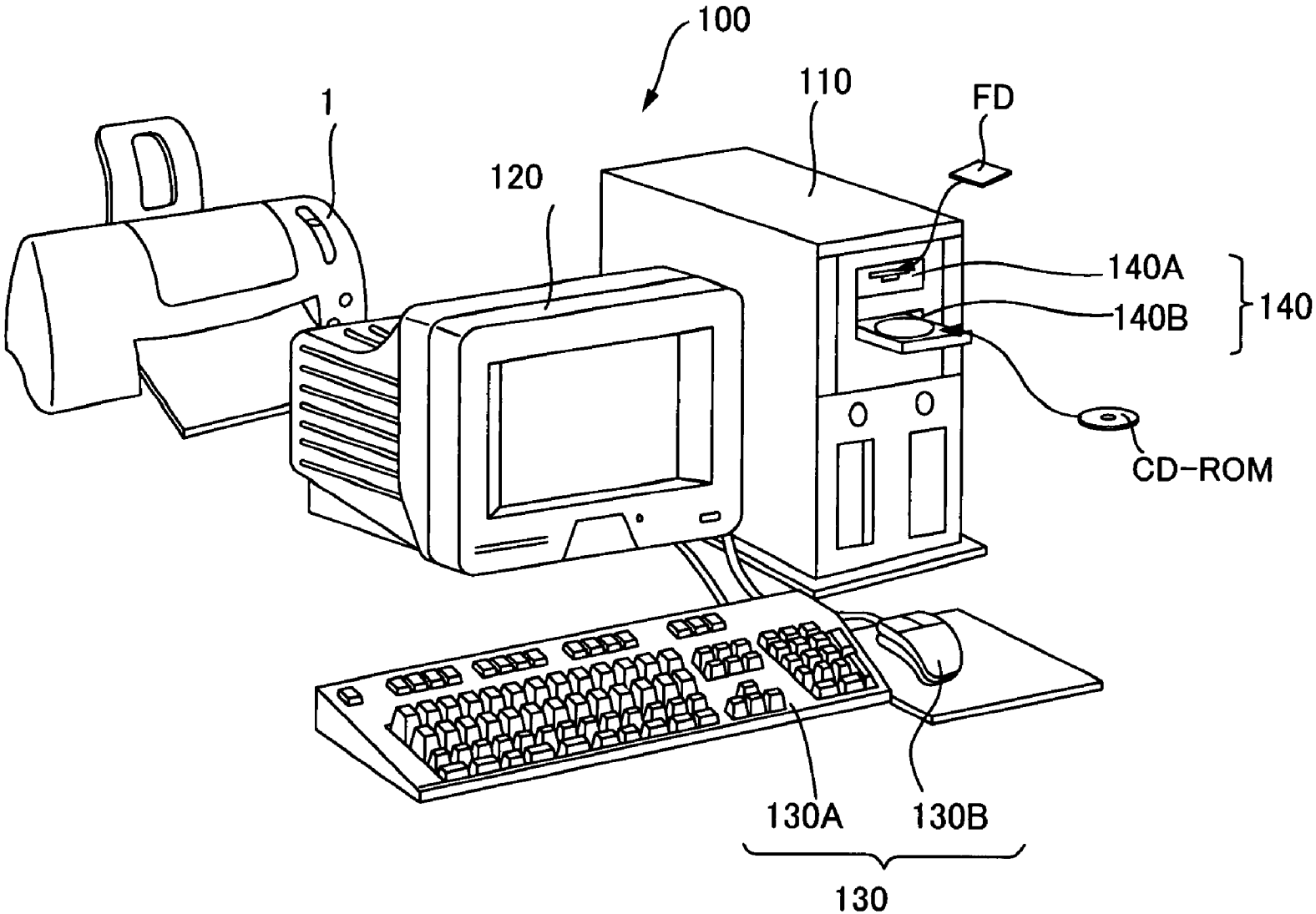
FIG. 1 is an explanatory diagram of the overall configuration of the printing system.

At least the following matters will become clear by the description in the present specification and the accompanying drawings.

A liquid ejecting apparatus that drives an element to eject a liquid onto a medium, comprises: a drive signal generator that is configured to generate a plurality of types of ejection drive signals for driving the element to eject the liquid; a sensor for detecting a temperature of the drive signal generator; and a controller that temporarily halts generation of the ejection drive signal from the drive signal generator based on the type of the ejection drive signal and a result of detection by the sensor.

With this liquid ejecting apparatus, it is possible to provide a liquid ejecting apparatus that is inexpensive and that has a fast processing speed.

In the foregoing liquid ejecting apparatus, it is preferable that power consumption of the drive signal generator is different for each type of the plurality of types of the ejection drive signals. The present invention is useful for liquid ejecting apparatuses that generate a plurality of ejection drive signals having different power consumption amounts. It is also preferable that each type of the plurality of types of the ejection drive signals has a different voltage. This is because if the voltages of the drive signals are different, then the amount of power consumed by the drive signal generator is different. It is also preferable that each type of the plurality of types of the ejection drive signals has a different waveform. This is because if the waveforms of the ejection drive signals are different, then the amount of power consumed by the drive signal generator is different.

In the foregoing liquid ejecting apparatus, it is preferable that the liquid ejecting apparatus repeatedly performs an ejection process of ejecting the liquid and a carrying process of carrying the medium; and that for each ejection process that is performed repeatedly, the generation of the ejection drive signal from the drive signal generator is temporarily halted based on the type of the ejection drive signal and the result of detection by the sensor. Thus, it is possible to radiate the heat of the drive signal generator for each ejection process. It is also preferable that the medium is continuous paper. If the heat of the drive signal generator is radiated for each ejection process, then it is possible to radiate the heat of the drive signal generator regardless of the length in the carrying direction of the printed image (or the print medium).

In the foregoing liquid ejecting apparatus, it is preferable that the liquid ejecting apparatus ejects the liquid consecutively onto a plurality of pieces of the medium; and that for each medium, the generation of the ejection drive signal from the drive signal generator is temporarily halted based on the type of the ejection drive signal and the result of detection by the sensor. Thus, the standby time does not change while printing the same sheet of paper. It is also preferable that the medium is cut paper. This is because with continuous paper, the amount of heat that builds up in the drive signal generator differs depending on the length in the carrying direction of the printed image, but with cut paper, the heat that builds up while printing a single sheet of paper is substantially the same.

In the foregoing liquid ejecting apparatus, it is preferable that a standby time for which the generation of the ejection drive signal from the drive signal generator is temporarily halted is determined in accordance with the type of the ejection drive signal and the result of detection by the sensor. Thus, it is possible for the liquid ejecting apparatus to perform standby at a standby time that corresponds to the power consumption of the ejection drive signal. It is also preferable that the standby time is made longer for the type of the ejection drive signal for which the power consumption of the drive signal generator is larger. This is because it becomes increasingly necessary to radiate the heat of the drive signal generator as the power consumption amount becomes larger. It is also preferable that the standby time is made longer the higher the temperature detected by the sensor is. This is because it becomes increasingly necessary to radiate the heat of the drive signal generator as the temperature of the drive signal generator becomes higher.

In the foregoing liquid ejecting apparatus, it is preferable that a threshold value is determined in correspondence with the type of the ejection drive signal; and that when the result of detection by the sensor exceeds the threshold value, the generation of the ejection drive signal from the drive signal generator is temporarily halted. By setting the threshold value in correspondence with the type of the ejection drive signal, the temperature at which standby is started will differ according to the type of the ejection drive signal, and in this way, standby is performed based on the type of the ejection drive signal. It is also preferable that the threshold value is set to a lower temperature for the type of the ejection drive signal for which the power consumption of the drive signal generator is larger. This is because if the power consumption of the drive signal generator is large, then even if the temperature detected by the sensor is the same, the actual temperature of the heat-producing sections of the drive signal generator becomes higher than in a case where the power consumption amount is small.

In the foregoing liquid ejecting apparatus, it is preferable that the liquid ejecting apparatus stops the generation of the ejection drive signal from the drive signal generator when the result of detection by the sensor exceeds a critical value; and that the critical value is determined in correspondence with the type of the ejection drive signal. Thus, a greater number of media can be processed consecutively.

In the foregoing liquid ejecting apparatus, it is preferable that the drive signal generator is configured to generate a non-ejection drive signal for driving the element such that the liquid is not ejected; and that the drive signal generator generates the non-ejection drive signal when temporarily halting the generation of the ejection drive signal. Thus, the liquid can be kept from hardening during standby.

In the foregoing liquid ejecting apparatus, it is preferable that the drive signal generator has a transistor; and that the transistor produces heat when the drive signal generator generates the ejection drive signal. Thus, inexpensive transistors can be used.

In the foregoing liquid ejecting apparatus, it is preferable that the sensor detects a temperature of a position that is different from a heat-producing section of the drive signal generator. In other words, it is advantageous to perform standby that corresponds to the type of the ejection drive signal in the case of a structure in which the sensor cannot detect the temperature of the heat-producing section directly.

It should be noted that a liquid ejecting apparatus that is furnished with all of the foregoing structural elements is capable of achieving all of these effects, and thus is advantageous.

Further, a liquid ejection method comprises: generating one of a plurality of types of ejection drive signals from a drive signal generator to make a liquid be ejected in correspondence with that ejection drive signal; detecting a temperature of the drive signal generator; and temporarily halting generation of the ejection drive signal from the drive signal generator based on the type of the ejection drive signal and the temperature of the drive signal generator.

With such a liquid ejection method, it is possible to eject a liquid onto a medium inexpensively and with a fast processing speed.

Further, a printing system comprises: a computer; and a printing apparatus that drives an element to eject an ink onto paper, and that is provided with: a drive signal generator that is configured to generate a plurality of types of ejection drive signals for driving the element; a sensor for detecting a temperature of the drive signal generator; and a controller that temporarily halts generation of the ejection drive signal from the drive signal generator based on the type of the ejection drive signal and a result of detection by the sensor.

With such a printing system, it is possible to provide an inexpensive printing system that has a fast printing speed.

===Configuration of Printing System ===

An embodiment of a printing system (computer system) is described next with reference to the drawings. However, the description of the following embodiment also includes implementations relating to a computer program and a storage medium that has the computer program recorded thereon, for example.

FIG. 1 is an explanatory diagram showing the external structure of the printing system. A printing system 100 is provided with a printer 1, a computer 110, a display device 120, an input device 130, and a record/play device 140. The printer 1 is a printing apparatus for printing images on a medium such as paper, cloth, or film. The computer 110 is electrically connected to the printer 1, and outputs print data corresponding to an image to be printed to the printer 1 in order to print the image with the printer 1. The display device 120 has a display, and displays a user interface such as an application program or a printer driver. The input device 130 is for example a keyboard 130A and a mouse 130B, and is used to operate an application program or adjust the settings of the printer driver, for example, in accordance with the user interface that is displayed on the display device 120. A flexible disk drive device 140A and a CD-ROM drive device 140B, for example, are employed as the record/play device 140.

A printer driver is installed on the computer 110. The printer driver is a program for achieving the function of displaying the user interface on the display device 120, and in addition it also achieves the function of converting image data that have been output from the application program into print data. The printer driver is recorded on a storage medium (computer-readable storage medium) such as a flexible disk FD or a CD-ROM. Also, the printer driver can be downloaded onto the computer 110 via the Internet. It should be noted that this program can be made of codes for achieving the various functions.

It should be noted that "printing apparatus" in a narrow sense means the printer 1, but in a broader sense it means the system constituted by the printer 1 and the computer 110.

===Printer Driver ===

<Regarding the Printer Driver>

On the computer 110, computer programs such as a video driver, an application program, and a printer driver operate under an operating system installed on the computer. The video driver has a function of displaying, for example, the user interface on the display device 120 in accordance with display commands from the application program and the printer driver. The application program, for example, has a function for performing image editing, for example, and creates data (image data) related to an image. A user can give an instruction to print an image that has been edited by the application program via the user interface of the application program. Upon receiving the print instruction, the application program outputs image data to the printer driver.

The printer driver receives the image data from the application program, converts the image data into print data, and outputs the print data to the printer. Here, "print data" refers to data in a format that can be interpreted by the printer 1 and that includes various command data and pixel data. Here, "command data" refers to data for instructing the printer to carry out a specific operation. Furthermore, "pixel data" refers to data about pixels that constitute an image (print image) to be printed, and is data about the dots that are formed at positions on the paper corresponding to the respective particular pixels (data for dot color and size, for example).

<Setting the Printer Driver>

Figure 2:
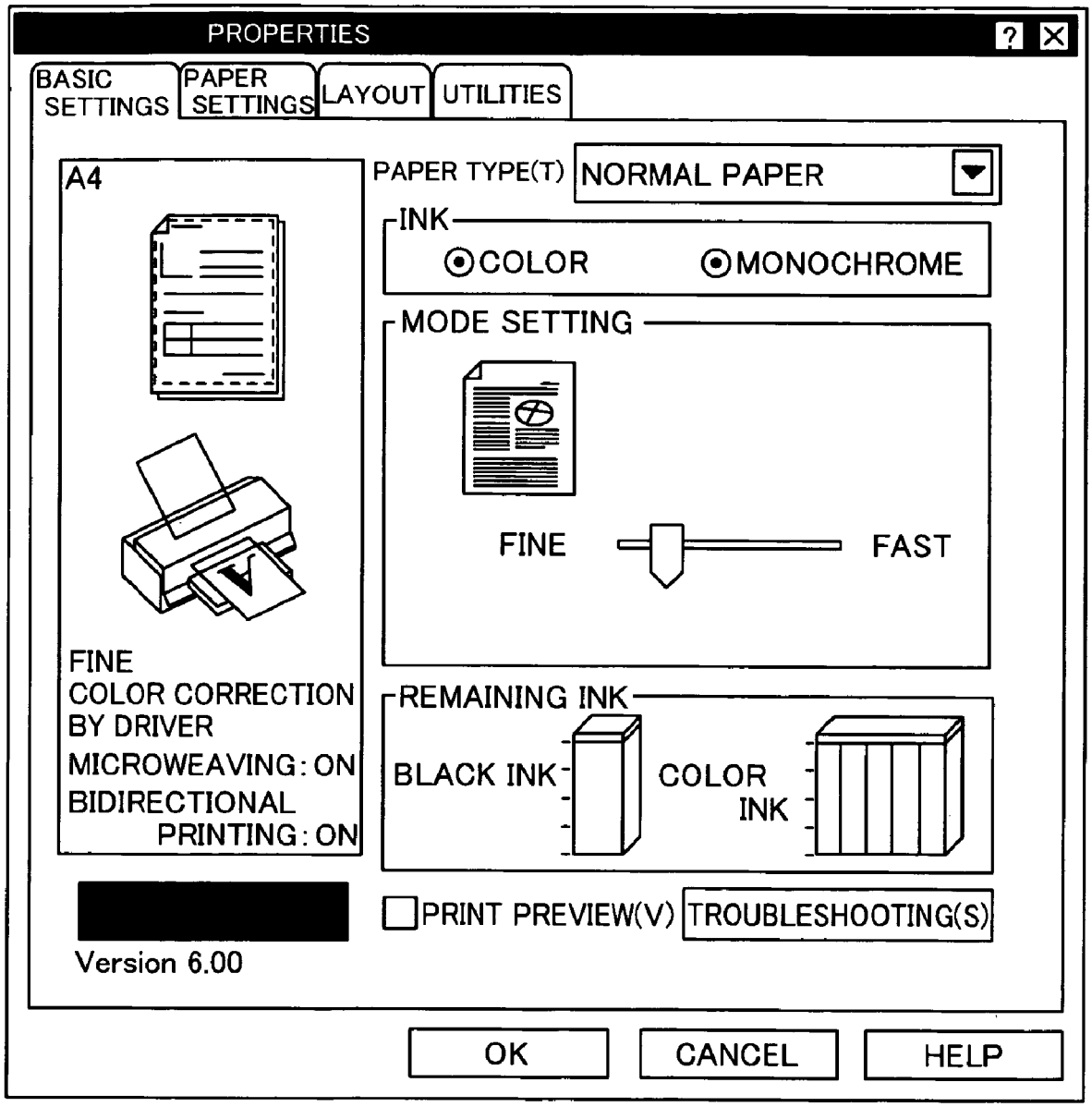
FIG. 2 is an explanatory diagram of the user interface of the printer driver.

FIG. 2 is an explanatory diagram of the user interface of the printer driver. The user interface of the printer driver is displayed on the display device via the video driver. The user can use the input device 130 to change the various settings of the printer driver.

The user can select the print mode from this screen. For example, the user can select, as the print mode, a fast print mode (fast) or a fine print mode (fine). The printer driver then converts the image data into print data such that the data are in the format corresponding to the selected print mode.

Furthermore, from this screen, the user can select the print paper to be used for printing. For example, the user can select plain paper or glossy paper as the print paper. Since different types of paper (paper grades) differ in how ink is absorbed and how ink dries, the amount of ink suited for printing also is different. For this reason, the printer driver converts image data into print data in correspondence with the selected paper grade.

The print resolution (dot pitch during printing) is determined based on the print mode and the print paper type that have been selected by the user. The movement speed of the carriage, which is discussed later, and the type of ejection drive signal COM also are determined based on the print mode and the print paper type that have been selected by the user. The information determined here is sent to the printer as the command data of the print data.

In this way, the printer driver converts image data into print data in accordance with the conditions set through the user interface.

===Configuration of the Printer ===

<Configuration of the Inkjet Printer>

Figure 3:
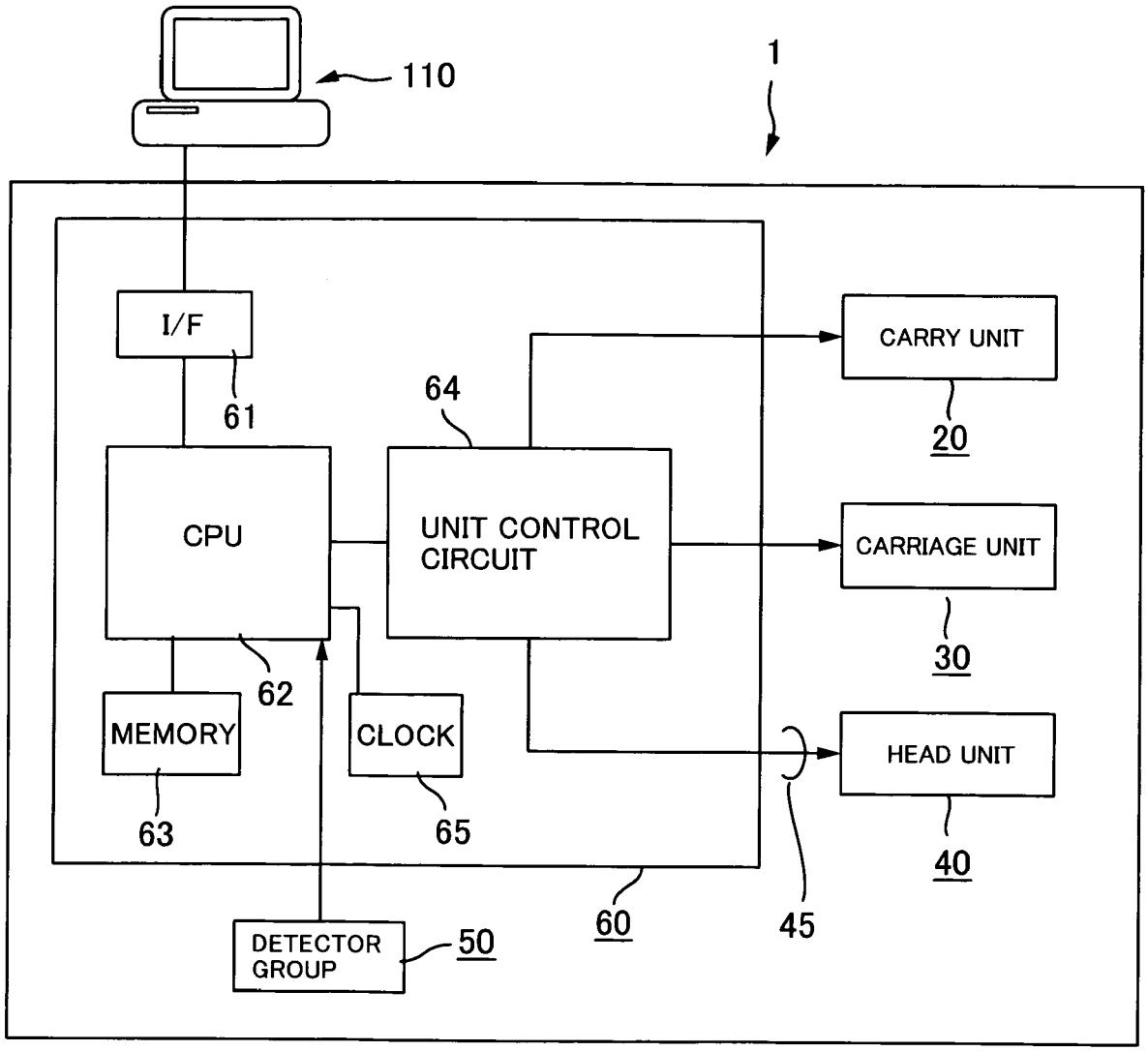
FIG. 3 is a block diagram of the overall structure of the printer.
Figure 4:
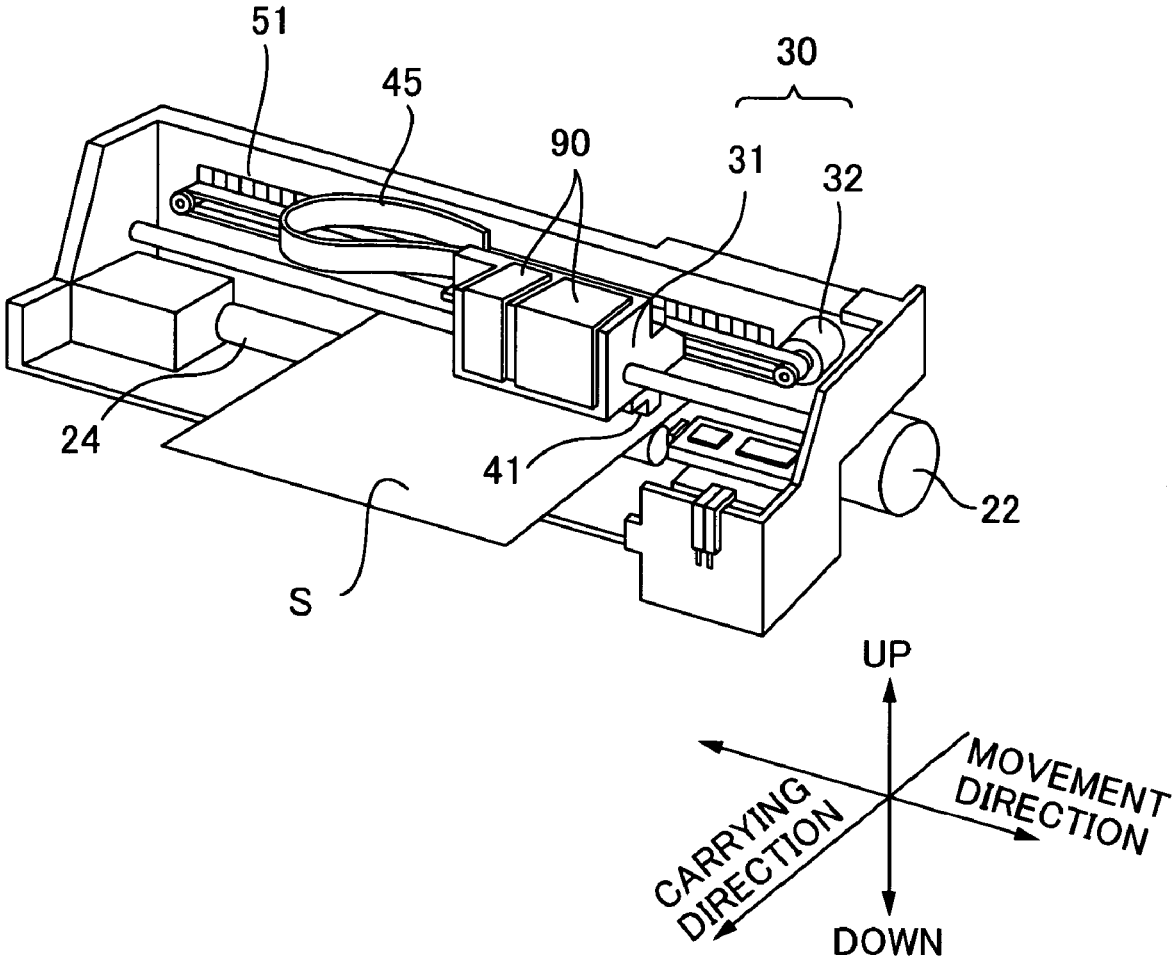
FIG. 4 is a schematic diagram of the overall structure of the printer.
Figure 5:
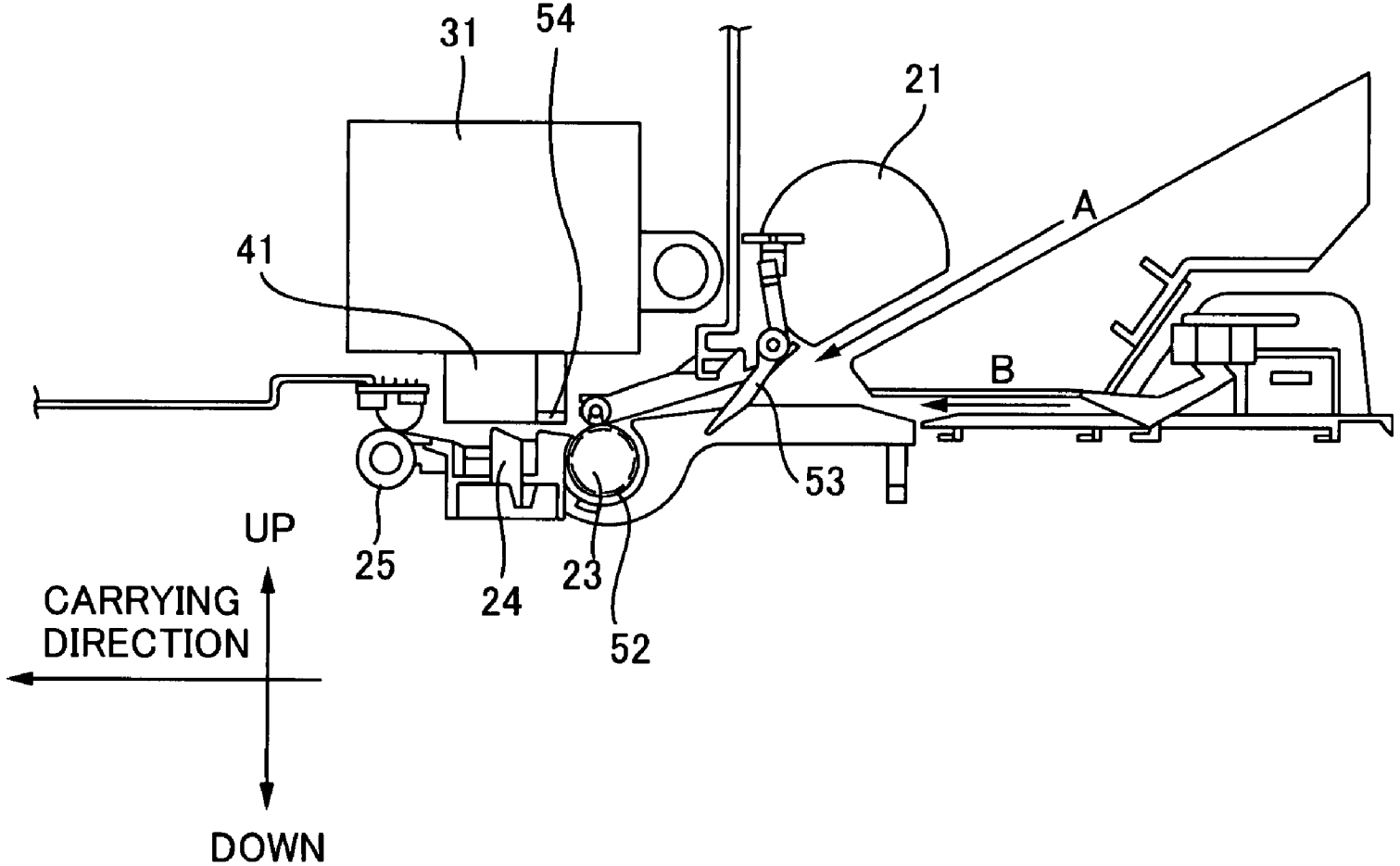
FIG. 5 is a transverse cross-sectional view of the overall structure of the printer.

FIG. 3 is a block diagram of the overall configuration of the printer of this embodiment. FIG. 4 is a schematic diagram of the overall configuration of the printer of this embodiment. FIG. 5 is lateral sectional view of the overall configuration of the printer of this embodiment. The basic structure of the printer according to the present embodiment is described below.

The printer of this embodiment has a carry unit 20, a carriage unit 30, a head unit 40, a detector group 50, and a controller 60. The printer 1 that has received the print data from the computer 110, which is an external device, controls the various units (the carry unit 20, the carriage unit 30, and the head unit 40) using the controller 60. The controller 60 controls the units in accordance with the print data that are received from the computer 110 to form an image on a paper. The detector group 50 monitors the conditions within the printer 1, and it outputs the results of this detection to the controller 60. The controller 60 receives the detection results from the detector group 50, and controls the units based on these detection results.

The carry unit 20 is for feeding a medium (for example, paper S) up to a printable position and carrying the paper in a predetermined direction (hereinafter, referred to as the carrying direction) by a predetermined carry amount during printing. In other words, the carry unit 20 functions as a carrying mechanism (carrying means) for carrying paper. The carry unit 20 has a paper supply roller 21, a carry motor (hereinafter, referred to as "PF motor") 22, a carry roller 23, a platen 24, and a paper discharge roller 25. However, the carry unit 20 does not necessarily have to include all of these structural elements in order to function as a carrying mechanism. The paper supply roller 21 is a roller for automatically supplying, into the printer, paper that has been inserted into a paper insert opening. The paper supply roller 21 has a transverse cross-sectional shape in the shape of the letter D, and the length of the circumference section thereof is set longer than the carrying distance to the carry roller 23, so that using this circumference section the paper can be carried up to the carry roller 23. The carry motor 22 is a motor for carrying paper in the carrying direction, and is constituted by a DC motor. The carry roller 23 is a roller for carrying the paper S that has been supplied by the paper supply roller 21 up to a printable region, and is driven by the carry motor 22. The platen 24 supports the paper S during printing. The paper discharge roller 25 is a roller for discharging the paper S for which printing has finished to the outside of the printer. The paper discharge roller 25 is rotated in synchronization with the carry roller 23. It should be noted that the printer has two routes, a route A for carrying cut paper such as A4 paper or B5 paper and a route B for carrying continuous paper such as roll paper (see FIG. 5).

The carriage unit 30 is for making the head move (also referred to as "scan") in a predetermined direction (hereinafter, referred to as the "movement direction"). The carriage unit 30 has a carriage 31 and a carriage motor (also referred to as "CR motor") 32. The carriage 31 can be moved back and fourth in the movement direction (thus, the head moves in the movement direction). Also, the carriage 31 detachably holds ink cartridges 90 that contain ink. The carriage motor 32 is a motor for moving the carriage 31 in the movement direction, and is constituted by a DC motor.

The head unit 40 is for ejecting ink onto paper. The head unit 40 has a head 41. The head 41 has a plurality of nozzles, which are ink ejecting sections, and ejects ink intermittently from the nozzles. The head 41 is provided in the carriage 31. Thus, when the carriage 31 moves in the movement direction, the head 41 also moves in the movement direction. A dot line (raster line) is formed on the paper in the movement direction as a result of the head 41 intermittently ejecting ink while moving in the movement direction. The head unit 40 obtains data for driving the head from the control unit on the printer body side via a cable 45. The cable 45 is a flexible belt-like cable that flexibly links the printer body and the carriage 31 and electrically links the printer body and the head unit 41.

The detector group 50 includes a linear encoder 51, a rotary encoder 52, a paper detection sensor 53, and an optical sensor 54, for example. The linear encoder 51 is for detecting the position of the carriage 31 in the movement direction. The rotary encoder 52 is for detecting the amount of rotation of the carry roller 23. The paper detection sensor 53 is for detecting the position of the front end of the paper to be printed. The paper detection sensor 53 is provided at a position where it can detect the position of the front end of the paper as the paper is being fed toward the carry roller 23 by the paper supply roller 21. It should be noted that the paper detection sensor 53 is a mechanical sensor that detects the front end of the paper through a mechanical mechanism. More specifically, the paper detection sensor 53 has a lever that can be rotated in the carrying direction, and this lever is disposed such that it protrudes into the path over which the paper is carried. In this way, the front end of the paper comes into contact with the lever and the lever is rotated, and thus the paper detection sensor 53 detects the position of the front end of the paper by detecting the movement of the lever. The optical sensor 54 is attached to the carriage 31. The optical sensor 54 detects whether or not the paper is present by its light-receiving section detecting reflected light of the light that is irradiated onto the paper by the light-emitting section. The optical sensor 54 detects the position of the edge section of the paper while being moved by the carriage 31. The optical sensor 54 detects the edge section of the paper optically, and thus has a higher detection precision than the mechanical paper detection sensor 53.

The controller 60 is a control unit (control means) for carrying out control of the printer. The controller 60 has an interface section 61, a CPU 62, a memory 63, a unit control circuit 64, and a clock 65. The interface section 61 is for exchanging data between the computer 110, which is an external device, and the printer 1. The CPU 62 is a computer processing device for performing the overall control of the printer. The memory 63 is for securing a working region and a region for storing the programs of the CPU 62, for instance, and includes memory means such as a RAM or an EEPROM. The CPU 62 controls the various units via the unit control circuit 64 in accordance with programs stored on the memory 63. The clock 65 outputs clock signals CK of a fixed period to the CPU 62 and the unit control circuit 64.

===Driving of the Head ===

Figure 6:
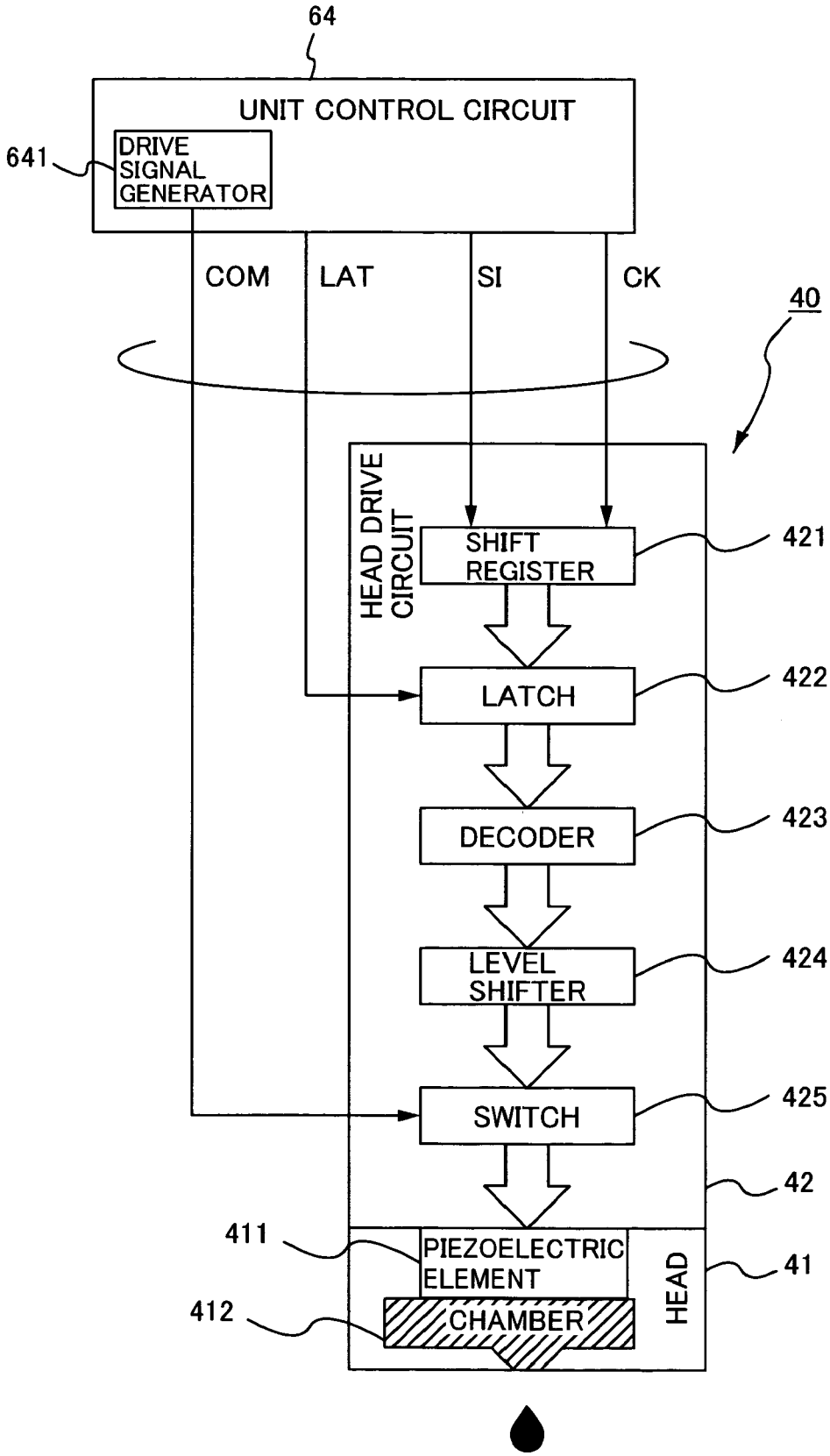
FIG. 6 is an explanatory diagram of the structural elements with which the head is driven.
Figure 7:
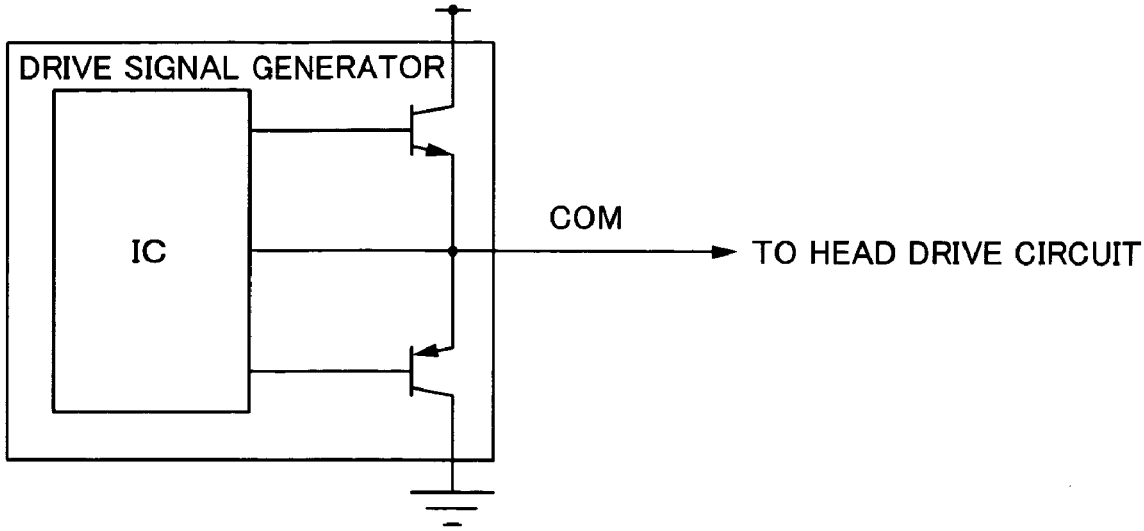
FIG. 7 is an explanatory diagram that schematically shows the electric circuit of the drive signal generator.
Figure 8:
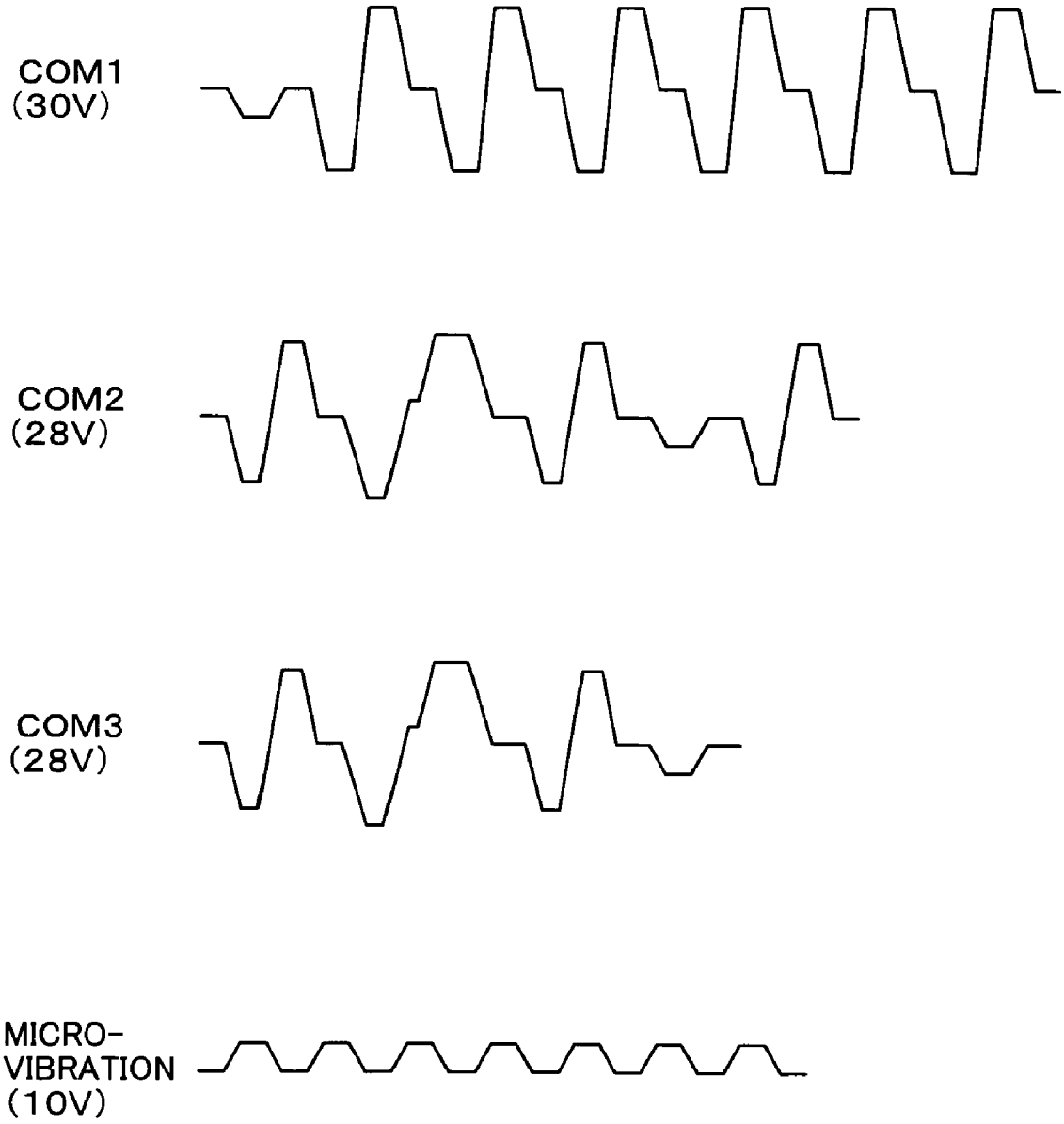
FIG. 8 is an explanatory diagram of the plurality of types of ejection drive signals that are generated by the drive signal generator.
Figure 9:
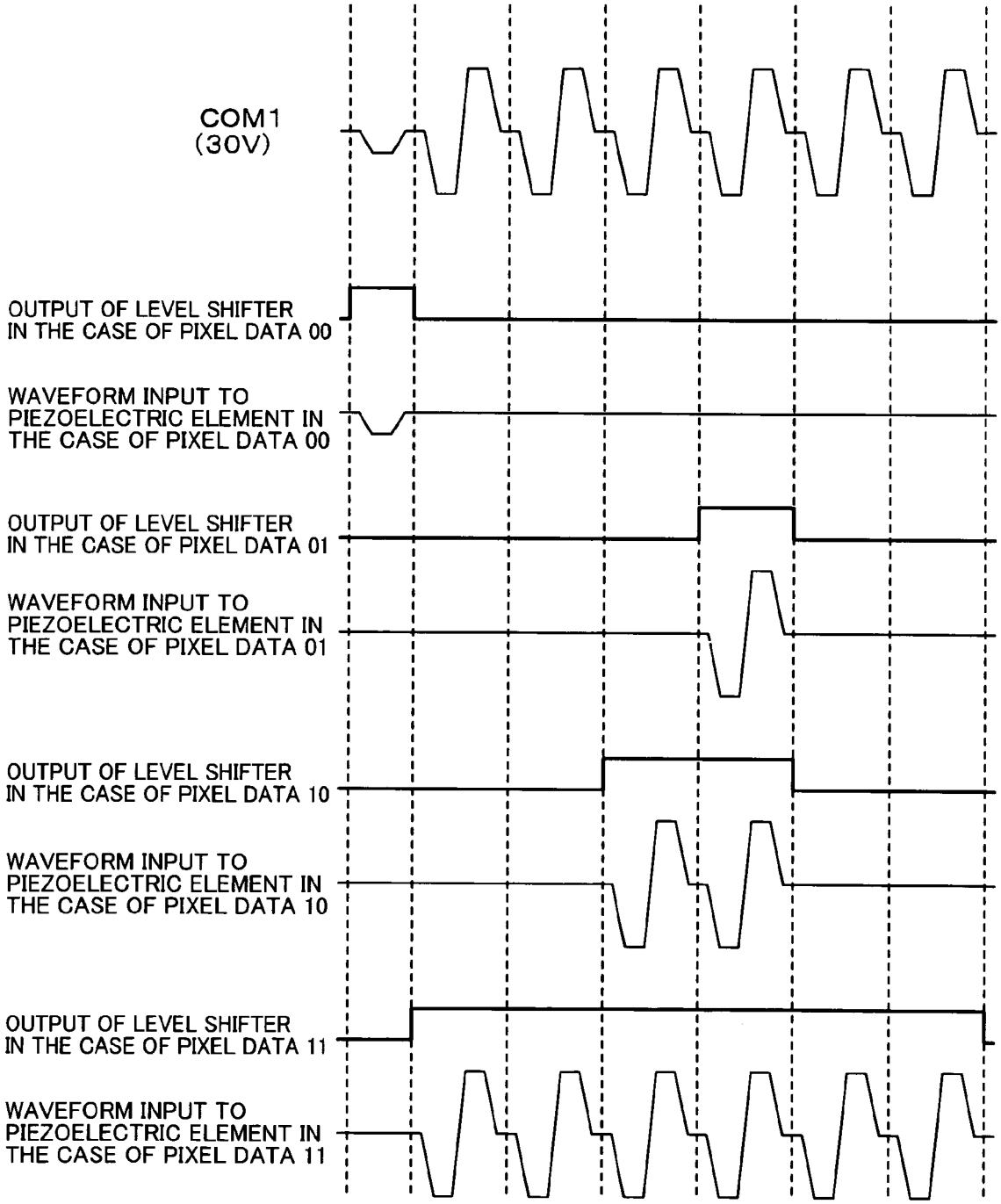
FIG. 9 is an explanatory diagram of the relationship between the pixel data, and the output signal of the level shifter and the signal input to the piezoelectric element.

FIG. 6 is an explanatory diagram of the structural elements for driving the head. FIG. 7 is an explanatory diagram that schematically shows the electric circuit of the drive signal generator. FIG. 8 is an explanatory diagram of the drive signals generated by the drive signal generator. FIG. 9 is an explanatory diagram showing the relationship between the pixel data, and the output signal of the level shifter and the signals input to the piezoelectric elements. Structural elements that have already been described are assigned identical reference numerals and thus description thereof is omitted.

The head unit 40 has the head 41 and head drive circuits 42 for driving the head 41. The head 41 is provided with a plurality of nozzles, and has piezoelectric elements 411 each provided corresponding to one of the nozzles, and a chamber 412. Each head drive circuit 42 is provided corresponding to one of the plurality of nozzles. Each head drive circuit 42 has a shift register 421, a latch circuit 422, a decoder 423, a level shifter 424, and a switch 425.

The unit control circuit 64 has a drive signal generator 641. The drive signal generator has two transistors Q1 and Q2 and an IC. The IC performs feedback to the transistors depending on the voltage on the emitter side of the two transistors. The voltage signal on the emitter side of the transistors is output, as an ejection drive signal COM, to the head drive circuits via the cable 45.

The drive signal generator 641 is capable of generating a plurality of types of ejection drive signals COM1 to COM3. The ejection drive signal COM1 is the drive signal when the printer is to perform printing at a resolution of 360 dpi. The ejection drive signal COM2 is the drive signal when the printer is to perform printing at a resolution of 720 dpi. The ejection drive signal COM2 has a shorter primitive period and a lower voltage than the ejection drive signal COM1. The ejection drive signal COM3 is the drive signal when the printer is to perform printing at a resolution of 1440 dpi. The ejection drive signal COM3 has one less waveform peak and a shorter primitive period than the ejection drive signal COM2. The drive signal generator 641 generates the ejection drive signal COM1 at 7 kHz and generates COM2 at 8 kHz.

The drive signal generator 641 is also capable of generating a non-ejection drive signal. The non-ejection drive signal is a drive signal for driving a piezoelectric element 411 such that it does not eject ink. The non-ejection drive signal has a lower voltage than the ejection drive signals COM. Thus, the amount of power that is consumed by the drive signal generator 641 when generating a non-ejection drive signal is less than the power consumed by the drive signal generator 641 when generating ejection drive signals COM.

The operation of the head drive circuits 42 is described next. The following description is of a case in which the drive signal generator 641 generates the ejection drive signal COM1.

The shift register 421 receives a clock signal CK from a clock 65 and receives a signal SI from the unit control circuit 64. The print signal SI that is sent from the unit control circuit is a signal indicating the 180 pieces of pixel data corresponding to the nozzles #1 to #180. In the present embodiment, a 2-bit pixel data is assigned to a single pixel, and because the 180 nozzles eject ink at the same time, the print signal SI includes a 360-bit signal. Each shift register receives the piece of pixel data, from among the pieces of pixel data of the print signal SI, that corresponds to the nozzle over which it has control.

A latch signal LAT is output from the unit control circuit 64 to the latch circuit 422 at a predetermined timing. Upon receiving the latch signal LAT, the latch circuit 422 latches the pixel data.

The pixel data that is latched by the latch circuit 422 is input to the decoder 423. The decoder 423 converts the 2-bit pixel data unit into pulse selection data (a pulse selection signal). If the ejection drive signal that is generated by the drive signal generator is COM1, then the decoder 423 converts pixel data "00" into the pulse selection data "1000000." Similarly, the decoder 423 converts pixel data "01" into the pulse selection data "0000100," converts pixel data "10" into the pulse selection data "0001100," and converts pixel data "11" into the pulse selection data "0111111."It should be noted that the decoder 423 converts the 2-bit pixel data into 7-bit pulse selection data because the ejection drive signal COM1 is constituted by 7 waveforms. If the number of waveforms that make up the ejection drive signal COM changes, then the number of bits of the pulse selection data also changes.

The level shifter 424 functions as a voltage amplifier. The level shifter 424 outputs L level (a voltage that cannot drive the switch 425, for example 0 volts) in the case where the pulse selection data is "0." Similarly, the level shifter 424 outputs H level (a voltage that can drive the switch circuit 425, for example a voltage of about several dozen volts) in the case where the pulse selection data is "1."

At the temporal points of the dashed lines in FIG. 9, a change signal CH is output from the unit control circuit to the head drive circuit (this is not shown). The level shifter 424 switches its output between L level and H level depending on the change signal CH that is sent at the temporal point of the dashed lines.

The switch 425 becomes the OFF state if the output of the level shifter is at L level, and becomes the ON state if the output of the level shifter is at H level. As a result, when the waveforms of the ejection drive signal COM1 are received by the switch 425 and the output of the level shifter is H level, then the waveforms at that time are input to the piezoelectric element 411, and the piezoelectric element 411 is driven according to those waveforms. When the waveforms of the ejection drive signal COM1 have been input to the switch 425 and the output of the level shifter is L level, then the waveforms at that time are not output to the piezoelectric element 411, and the piezoelectric element 411 is not driven For example, in the case of the pixel data "00", only the first waveform of the seven waveforms making up the ejection drive signal COM1 is output to the piezoelectric element. The first waveform of COM1 is a waveform that drives the piezoelectric element to an extent at which it cannot eject ink from the nozzle. That is, the piezoelectric element 411 is driven even though it does not eject ink from the nozzle, and expands/contracts the chamber to circulate the ink and keep the nozzle from becoming clogged.

Also, in the case of the pixel data "01" to "11," the waveforms in the middle portion of the ejection drive signal COM1 are input to the piezoelectric element. The larger the pixel data, the greater the number of waveforms that are input to the piezoelectric element becomes, the greater the amount of the ink droplet that is ejected becomes, and the larger the dot that is formed on the paper becomes.

The printer, due to the above operation, does not form a dot in the case of pixel data "00," forms a small dot in the case of pixel data "01," forms a medium dot in the case of pixel data "10," and forms a large dot in the case of pixel data "11."

The above description addresses only the operation for forming a single dot to a single pixel, but in practice, the head 41 intermittently ejects ink droplets while the carriage 31 is moving, and thus the above operation is continuously repeated.

It should be noted that the non-ejection drive signal is not a signal for driving the piezoelectric elements based on pixel data, and thus when the drive signal generator 641 generates a non-ejection drive signal, the piezoelectric elements are driven by that non-ejection drive signal as it is.

===Generation of Heat by the Drive Signal Generator ===

As discussed above, the drive signal generator has two transistors Q1 and Q2. These two transistors produce heat when an ejection drive signal COM is generated. When the transistors themselves are elevated to a high temperature due to this production of heat, there is a possibility that the transistors may be destroyed. Accordingly, in order to keep the transistors from being destroyed by high temperature, a temperature sensor is provided and the controller 60 controls the temperature of the transistors.

Figure 10A:
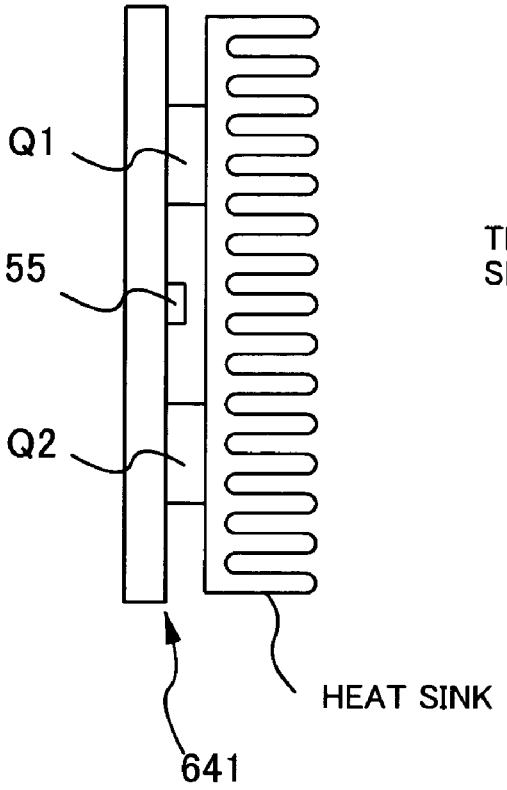
FIG. 10A is a lateral view of the circuit board.
Figure 10B:
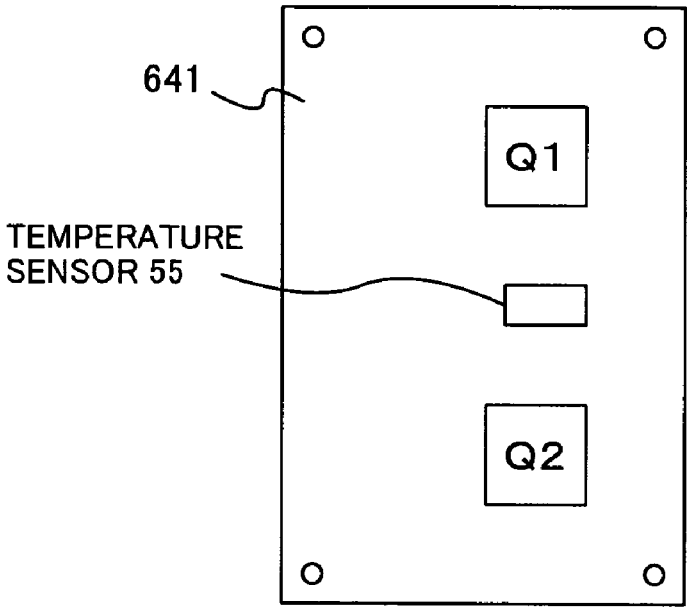
FIG. 10B is a top view of the circuit board when the heat sink has been removed.

FIG. 10A and FIG. 10B are explanatory diagrams illustrating the position where the temperature sensor is attached. The casing of the transistor Q1 and the casing of the transistor Q2 are provided on the circuit board of the drive signal generator 641. FIG. 10A is a view of the circuit board from the side, and FIG. 10B is a view of the circuit board from above after the heat sink has been removed.

The two transistors Q1 and Q2 are provided such that they are sandwiched between the circuit board and the heat sink. The heat sink is in contact with the transistors, and when the transistors produce heat, the heat is transmitted to the heat sink and radiated to the outside.

When the heat sink is made compact, the amount of heat produced by the transistors that is radiated becomes small, making the transistors prone to becoming high temperature. However, if the temperature of the transistors could be suitably controlled, then the temperature at which the transistors are destroyed can be discerned, thus allowing the heat sink to be provided compact. If a compact heat sink can be provided, then the overall size of the printer also can be made compact. Accordingly, in this embodiment, a temperature sensor 55 is provided on the circuit board in order to control the temperature of the transistors.

The temperature sensor 55 is provided between the casings of the two transistors. The temperature sensor 55 indirectly detects the temperature of the transistors by directly detecting the temperature of the circuit board and the surrounding area.

On the other hand, there is a section in the semiconductor constituting the transistors that is called the junction, and heat is generated at this junction. The heat that is generated is thermally conducted through the transistor itself and escapes to the outside. There is a maximum temperature that is allowed at the junction for each transistor, and this temperature is called the junction temperature (or the junction portion temperature). The transistor is destroyed by heat when the junction temperature becomes elevated to 125° C. or more.

Accordingly, the relationship between the junction temperature and the temperature of the casing (temperature detected by the temperature sensor 55) becomes an issue.

When Tj is the junction temperature and Tp is the casing temperature, then the relationship between Tj and Tp is expressed by the following expression. (It should be noted that Rθjc is the heat loss from the junction to the casing; also, P is the power consumption.)

$$Tj=R\theta jc\times P+Tp$$

It can be understood from this expression that, even at the same casing temperature Tp, a large power consumption P will result in a higher junction temperature Tj than a small power consumption P. In other words, even when the detection result of the temperature sensor 55 is the same, a large power consumption by the transistor results in a state where the transistor is more prone to breaking down.

Incidentally, the power consumption of the transistor differs depending on the type of ejection drive signal COM that is generated by the transistor. For example, if the drive signal generator 641 generates the ejection drive signal COM1, then the power consumption of the transistor will be larger than if it generates the ejection drive signal COM2 or the ejection drive signal COM3.

Accordingly, in this embodiment, the generation of the ejection drive signals COM is temporarily halted (brought into standby) based on the detection results of the temperature sensor and the type of ejection drive signal COM in order to keep the temperature of the transistor itself from rising.

===Control Method of the Present Embodiment ===

<Printing Process>

Figure 11:
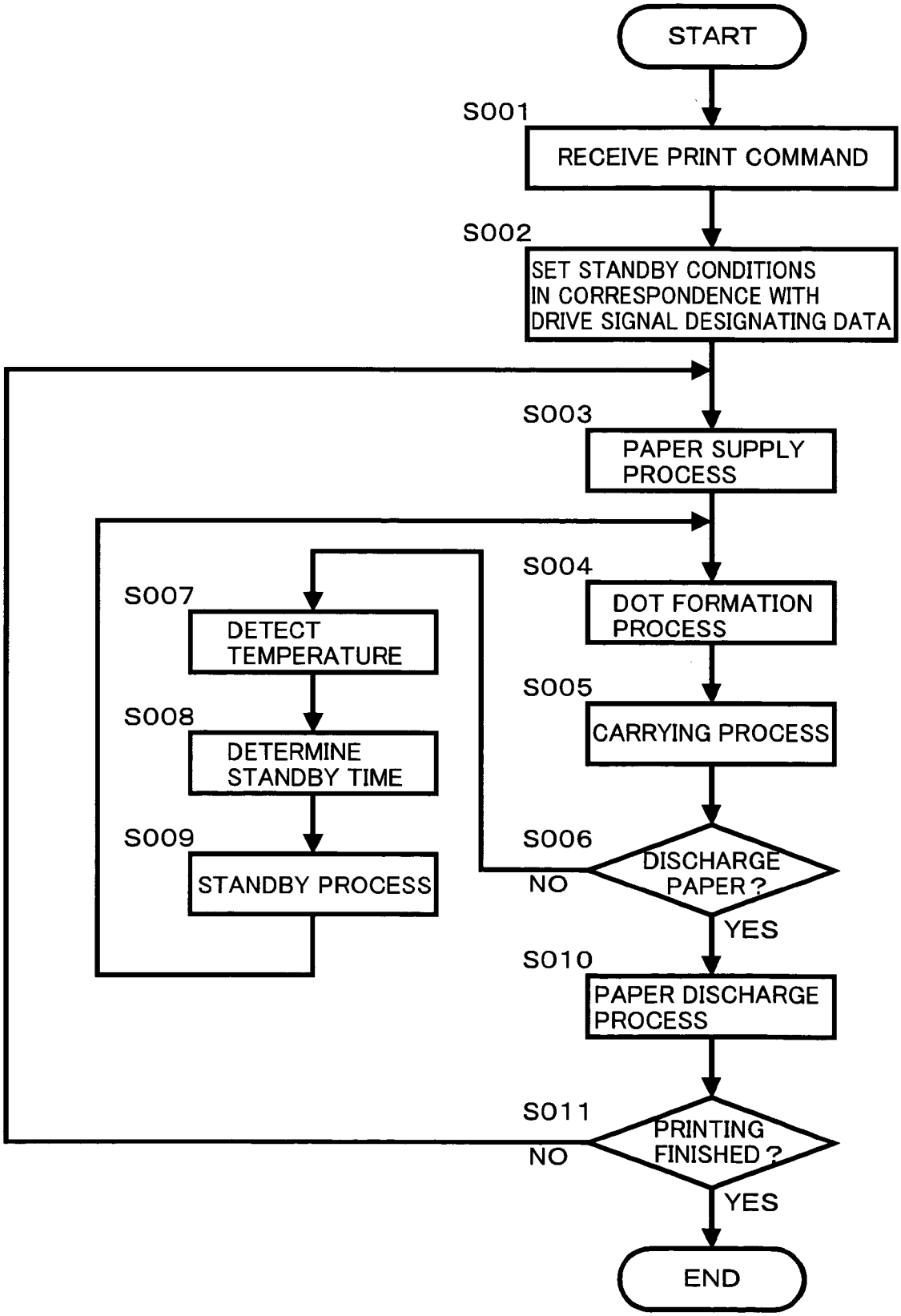
FIG. 11 is a flowchart of the printing process.

FIG. 11 is a flowchart of the printing process. The processes described below are executed by the controller 60 controlling the various units in accordance with a program stored on the memory 63. This program has codes for executing the various processes.

Also, FIGS. 12A to 12C are tables showing the standby conditions. The table of FIG. 12A shows the standby conditions of COM1, the table of FIG. 12B shows the standby conditions of COM2, and the table of FIG. 12C shows the standby conditions of COM3. The standby conditions show the relationship between the temperature detected by the temperature sensor 55 and the standby time by which the generation of the ejection drive signal is temporarily halted. The three standby conditions are stored within the memory 63.

The controller 60 receives a print command from the computer 110 via an interface section 61 (S001). This print command is included in the header of the print data transmitted from the computer 110. The controller 60 then analyzes the content of the various commands included in the print data that are received and uses the various units to perform the following paper supply process, carrying process, and ink ejection process, for example.

In this embodiment, the print data includes drive signal designating data as command data. The drive signal designating data is information for designating which of the three types of ejection drive signals COM1 to COM3 to use when printing. The explanation here is made assuming that the drive signal designating data designates the ejection drive signal COM1.

Next, the controller 60 sets the standby conditions according to the drive signal designating data in the print data (S002). Here, since the drive signal designating data designates the ejection drive signal COM1, the controller 60 sets, from the three standby conditions, the standby conditions of FIG. 12A.

Next, the controller 60 performs the paper supply process (S003). The paper supply process is a process for supplying paper to be printed into the printer and positioning the paper at a print start position (also referred to as the "indexed position"). The controller 60 rotates the paper supply roller 21 to feed the paper to be printed up to the carry roller 23. The controller 60 then causes the carry roller 23 to rotate to position the paper that has been fed from the paper supply roller 21 at the print start position. When the paper has been positioned at the print start position, at least some of the nozzles of the head 41 are in opposition to the paper. It should be noted that during the paper supply process, the controller 60 uses the drive signal generator 641 to generate a non-ejection drive signal. Due to the non-ejection drive signal, the piezoelectric elements vibrate the chambers 412 and agitate the ink within the chambers, thus allowing hardening of the ink within the chambers to be inhibited.

Next, the controller 60 performs the dot formation process (S004). The dot formation process is a process for intermittently ejecting ink from a head that moves in the movement direction so as to form dots on the paper. The controller 60 drives the carriage motor 32 to move the carriage 31 in the movement direction. The controller 60 then causes the ejection of ink from the head in accordance with the print data during the period that the carriage 31 is moving. Dots are formed on the paper when the ink droplets that are ejected from the head land on the paper.

During the dot formation process, the controller 60 uses the drive signal generator 641 to continually generate the ejection drive signal COM1, which has been designated by the drive signal designating data. At this time, the two transistors Q1 and Q2 produce heat.

Next, the controller 60 performs the carrying process (S005). The carrying process is a process for moving the paper in the carrying direction relative to the head. The controller 60 drives the carry motor to rotate the carry roller and thereby carry the paper in the carrying direction. Through this carrying process the head 41 becomes able to form dots at positions that are different from the positions of the dots formed in the preceding dot formation process.

During the carrying process, the controller 60 uses the drive signal generator 641 to generate a non-ejection drive signal. Due to the non-ejection drive signal, the piezoelectric elements vibrate the chambers 412 and agitate the ink within the chambers, thus allowing hardening of the ink within the chambers to be inhibited. It should be noted that the controller 60 continues to let the drive signal generator 641 generate the non-ejection drive signal until the next dot formation process is started.

Next, the controller 60 determines whether or not to discharge the paper being printed (S006). The paper is not discharged if there are still data for printing on the paper that is being printed.

If the paper is not to be discharged (NO in S006), then the controller 60 detects the temperature based on the output of the temperature sensor 55 (S007). Because this follows the dot formation process, the junction temperature of the transistors has risen and the temperature around the transistors also has risen. First, a case in which the temperature detected by the temperature sensor 55 is 40° C., which is slightly higher than room temperature, is described.

The controller 60 determines the standby time based on the temperature detected by the temperature sensor 55 and the standby conditions for COM1 (see FIG. 12A). Here, because 40° C. is the temperature detected by the temperature sensor 55, the controller 60 determines that the standby time is zero seconds. Next, the controller 60 performs standby in accordance with the standby time that has been determined (S009). However, in this example, standby is not performed since the standby time is zero seconds. Thus, the controller 60 immediately starts the next dot formation process. The controller 60 then repeats the above operations of S004 to S009.

The controller 60 repeatedly performs the dot formation process and the carrying process in alternation until there are no more data for printing, and then when there are no more data for printing to the paper that is being printed (YES in S006), the controller 60 causes that paper to be discharged (S010). The controller 60 discharges the printed paper to the outside by rotating the paper discharge roller. It should be noted that whether or not to discharge the paper can also be determined based on a paper discharge command included in the print data.

After discharging the paper, the controller 60 determines whether or not to continue printing (S011). If a next sheet of paper is to be printed, then printing is continued and the paper supply process for the next sheet of paper is started. If a next sheet of paper is not to be printed, then the printing operation is ended.

The temperature of the transistors rises when the dot formation process (S004) is performed repeatedly, and the temperature of the transistor casing also rises. The following description is for a case in which the temperature that is detected by the temperature sensor 55 in S007 has reached 61° C.

The controller 60 determines the standby time based on the temperature detected by the temperature sensor 55 and the standby conditions for COM1 (see FIG. 12A). Here, because 61° C. is the temperature detected by the temperature sensor 55, the controller 60 determines that the standby time is one second. Next, the controller 60 performs standby in accordance with the standby time that has been determined (S009). In this standby process, the controller 60 temporarily halts the generation of the ejection drive signal COM1 by the drive signal generator 641 by one second. During standby the drive signal generator 641 does not use the transistors, and thus a rise in transistor temperature is inhibited.

The printer performs standby of one second per every dot formation process while the temperature that is detected by the temperature detection sensor is equal to or more than 60° C. and less than 65° C. Because there is a standby time between each dot formation process, the time until a single sheet of paper is printed becomes longer.

When the temperature that is detected by the temperature sensor 55 becomes 65° C. or more, then the controller 60 extends the standby time from one second to three seconds, increasing the amount of heat that is radiated from the casing of the transistors during standby. The standby time is set such that if the user is using the printer normally, the temperature that is detected by the temperature sensor 55 during printing with the ejection drive signal COM1 does not exceed 70° C.

If the temperature that is detected by the temperature sensor exceeds 70° C., then the junction temperature of the transistors has come close to 125° C. (the temperature at which the transistors are destroyed), and thus the controller 60 stops the overall printing process of the printer. At this time, the controller 60 sends error information to the printer driver on the computer side. The printer driver receives the error information and displays an error message on the display.

It should be noted that a detected temperature by the temperature sensor of less than −20° C. also does not fall within the intended usage conditions, and thus at such a time as well the controller 60 stops printing and performs an error process.

<About Temperature Change>

Figure 13:
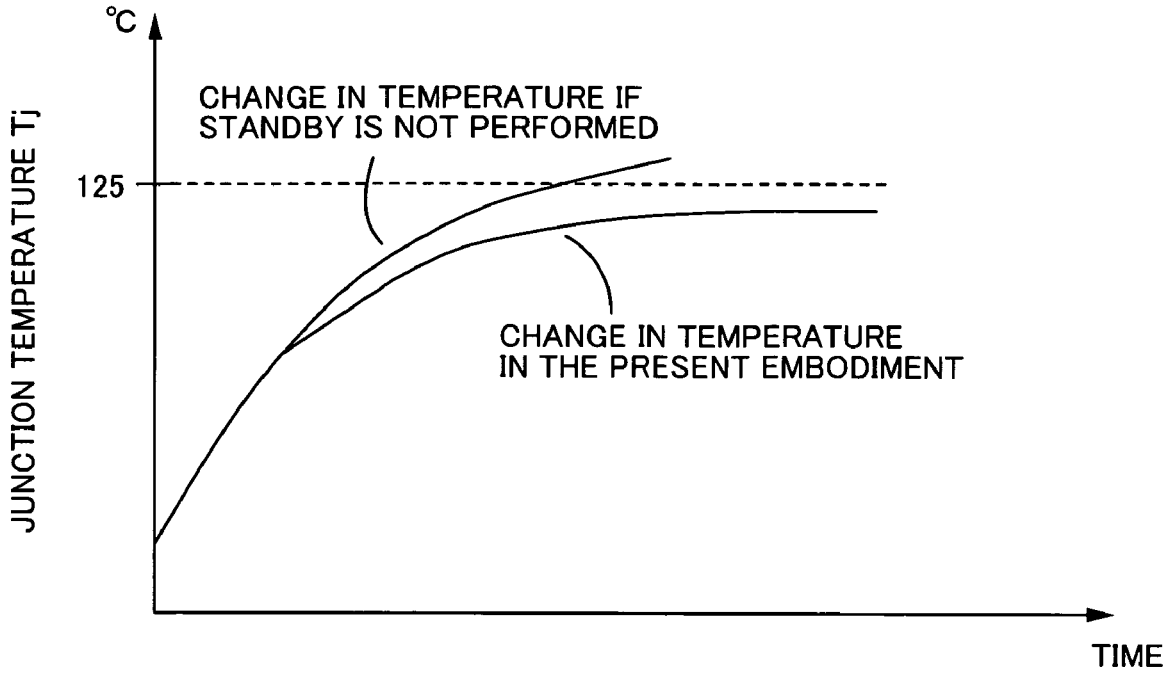
FIG. 13 is a graph plotting the change in the junction temperature Tj over time when printing is continued.

FIG. 13 is a graph showing the change over time in the junction temperature Tj when printing is continued. The vertical axis of the graph shows the temperature (° C.) and the horizontal axis shows time. It should be noted that the horizontal time axis is a time axis of printing around between several dozen sheets to several hundred sheets.

If standby is not performed and printing is continued, then the junction temperature Tj continues to rise. When printing is continued for a while, then the junction temperature reaches 125° C. and destroys the transistors, and the printer breaks down.

On the other hand, when standby is performed as in the present embodiment, then when the junction temperature Tj becomes high (when the casing temperature becomes approximately 60° C.) the printer performs standby. As a result, the printing speed per sheet of paper becomes slower but the junction temperature is kept from rising.

<A Case Where the Standby Time Has Been Set to Three Seconds from the Start>

Figure 14:
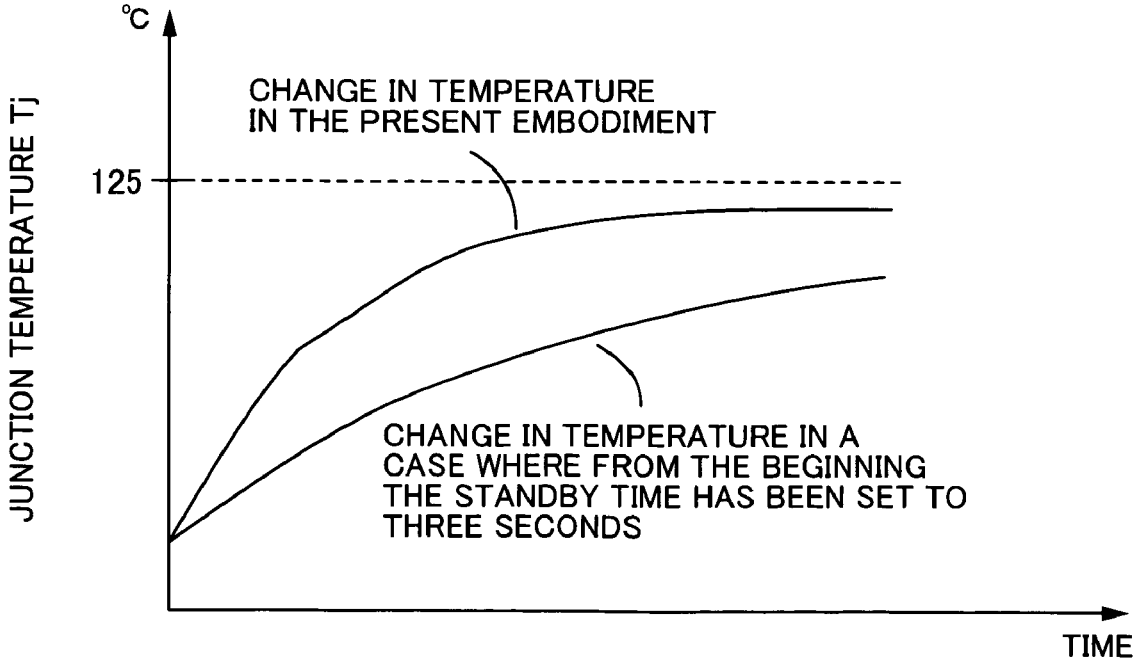
FIG. 14 is a graph plotting the change in the junction temperature Tj when the standby time is three seconds for all cases.

FIG. 14 is a graph showing the temperature change of the junction temperature Tj when the standby time is set to three seconds from the start. If the standby time is set to three seconds from the start, then a rise in the junction temperature can be inhibited from the start more so than in the present embodiment.

In this case, however, a standby process in which the standby time is three seconds is performed even when the junction temperature Tj is low, and thus the printing speed per sheet of paper becomes slow.

On the other hand, in the present embodiment, standby is not performed (the standby time is zero seconds) until the temperature that is detected by the temperature detection sensor 55 reaches 60° C., and thus the printing speed of the printer is faster than a case where the standby time is set to three seconds from the beginning. Also, in the present embodiment, standby of one second is performed until the temperature that is detected by the temperature detection sensor 55 reaches 65° C., and thus the printing speed of the printer is faster than a case where from the beginning a standby time of three seconds has been set.

With the present embodiment, the junction temperature Tj becomes higher than in a case where the standby time is set to three seconds from the start. However, even with the present embodiment, the junction temperature Tj does not exceed 125° C., and thus the transistors can be kept from being destroyed.

<Relationship Between Type of Ejection Drive Signal and Standby Conditions>

Figure 15:
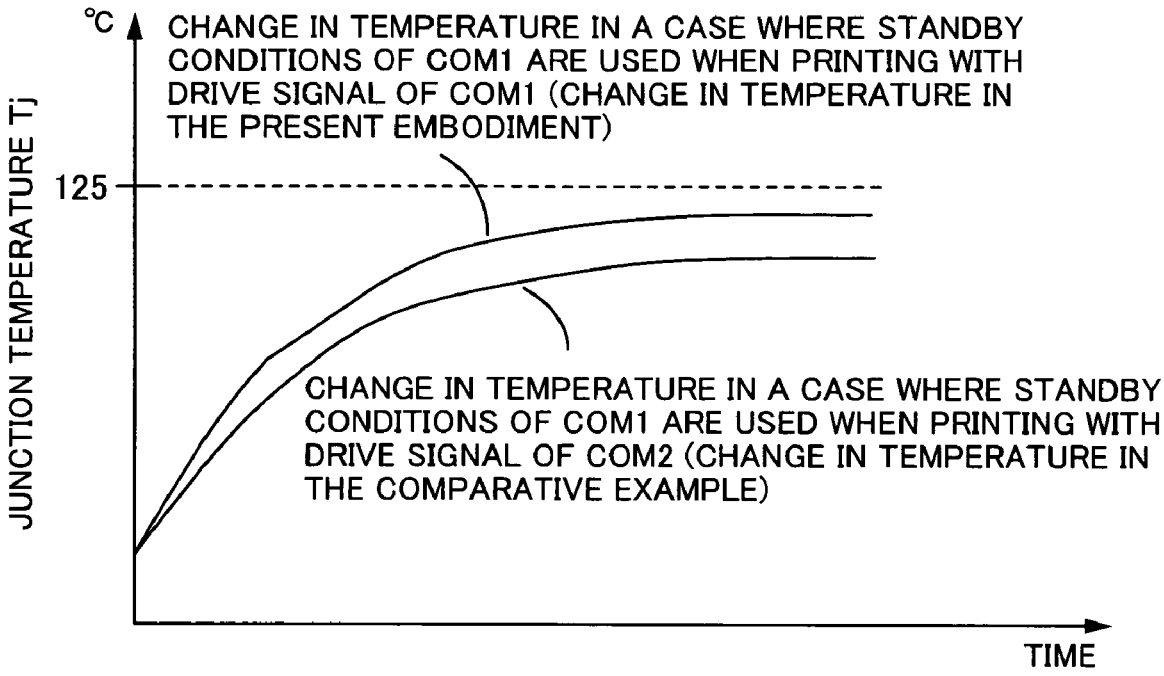
FIG. 15 is a graph plotting the change in the junction temperature Tj in the case of a comparative example.

FIG. 15 is a graph showing the temperature change of the junction temperature Tj when the same standby conditions are adopted regardless of the type of the ejection drive signal (comparative example). Here, for the sake of comparison, standby is performed according to the standby conditions of COM1 (FIG. 12A) even when the printer performs printing with the ejection drive signal COM2 (normally, standby would be carried out according to the standby conditions of COM2 when the printer performs printing with the ejection drive signal COM2).

As mentioned earlier, when printing is performed with the ejection drive signal COM2, the power consumption of the transistors is less than that for the ejection drive signal COM1. Thus, when the printer carries out printing using the ejection drive signal COM2 and standby is performed using the standby conditions for the ejection drive signal COM1, for which power consumption is high, then standby is performed even when the junction temperature Tj is low, thereby lowering the printing speed per single sheet of paper.

Accordingly, in the present embodiment, the standby conditions are changed in accordance with the type of the ejection drive signal COM. For example, when the printer performs printing using the ejection drive signal COM2, then standby is carried out in accordance with different standby conditions than the standby conditions for COM1 (see FIG. 12B).

Thus, when the printer performs printing using the ejection drive signal COM2, standby is not performed until the temperature that is detected by the temperature detection sensor 55 reaches 70° C. As a result, the printer of the present embodiment has a faster printing speed than in the case of the above comparative example during the period that the temperature detected by the temperature detection sensor 55 is from 60° C. to 70° C.

Also, in the present embodiment, the standby time is set to 0.5 seconds during the period that the temperature detected by the temperature detection sensor 55 is from 70° C. to 75° C. Thus, the printing speed is faster with the present embodiment than in a case where the standby time is one second.

Also, in the present embodiment, printing is continued until the temperature detected by the temperature detection sensor 55 reaches 80° C. Thus, the number of sheets of paper that can be consecutively printed in the present embodiment is greater than a case where printing is stopped at 70° C.

===Other Embodiments ===

The foregoing embodiment primarily described a printer. However, it goes without saying that the foregoing description also includes the disclosure of printing apparatuses, recording apparatuses, liquid ejecting apparatuses, printing methods, recording methods, liquid ejection methods, printing systems, recording systems, computer systems, programs, storage media storing programs, display screens, screen display methods, and methods for producing printed material, for example.

A printer, for example, was described above as one embodiment. However, the foregoing embodiment is for the purpose of elucidating the present invention and is not to be interpreted as limiting the present invention. The invention can of course be altered and improved without departing from the gist thereof and includes equivalents. In particular, the embodiments mentioned below are also included in the invention.

<Regarding the Standby Process>

In the foregoing embodiment, the printer performed standby between dot formation processes being executed repeatedly. However, the timing for standby is not limited to this.

Figure 16:
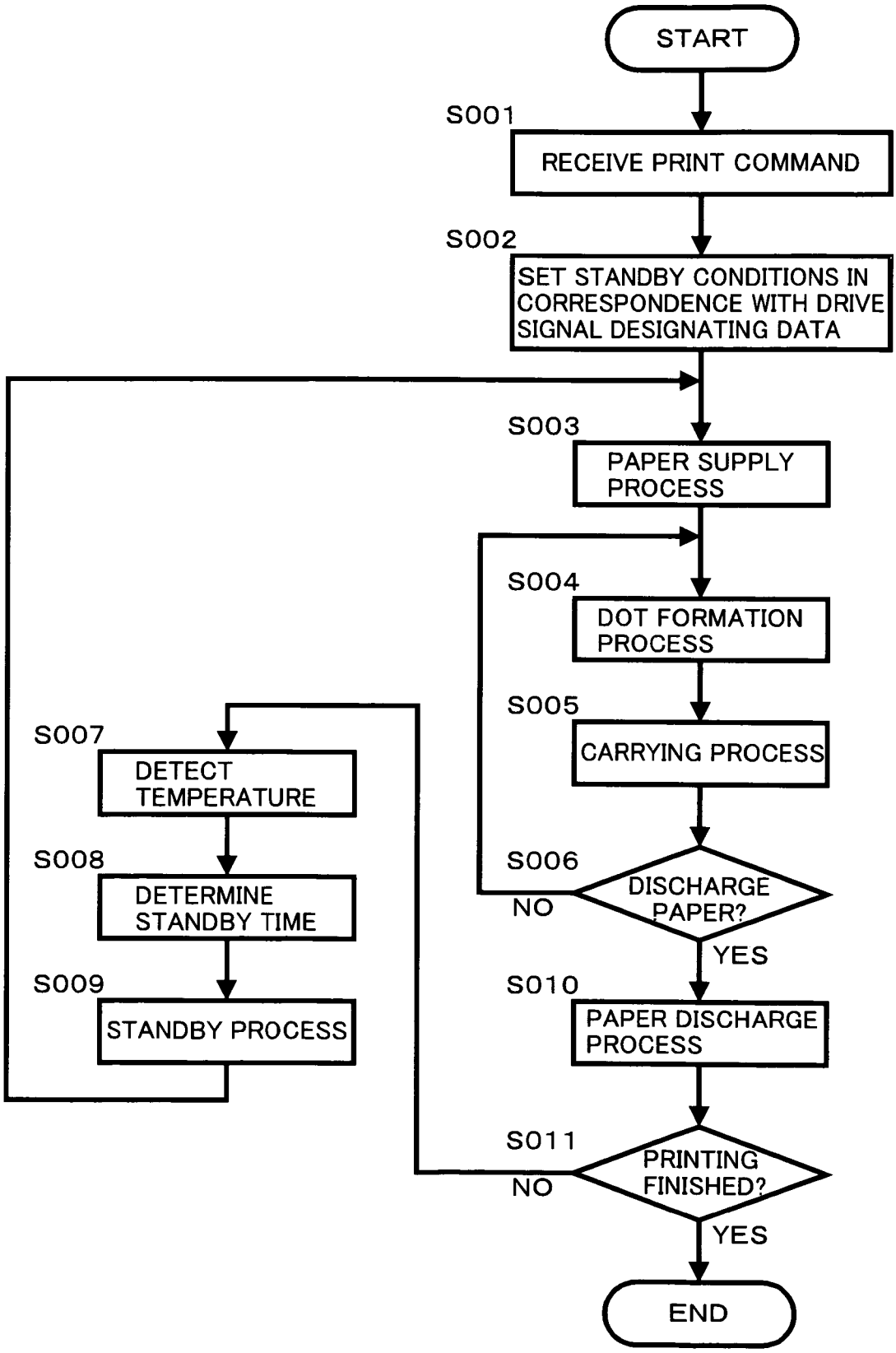
FIG. 16 is a flowchart for describing another timing for the standby process.

FIG. 16 is a flowchart for describing another timing for standby. In this implementation, standby is performed each time the printer prints a sheet of paper. With this standby timing as well, it is possible to perform standby in accordance with the type of ejection drive signal COM.

It should be noted that FIG. 17A to FIG. 17C are tables showing the standby conditions for this implementation. Compared to the embodiment discussed above, the standby time is long. This is in order to discharge the heat that builds up during the printing of a single sheet of paper.

In the case of performing standby each time that the printer prints a sheet a paper, the standby time can be changed depending on the size of the paper even if the same type of the waveform signal COM is used. For example, the standby time when printing a plurality of sheets of A4 size paper is longer than the standby time when printing a plurality of sheets of A5 size paper. This is because the larger the paper, the greater the amount of heat builds up during the printing of a single sheet of paper. Consequently, in this case, the memory 63 of the printer stores tables such as those of FIG. 17A to FIG. 17C corresponding to paper type.

With this implementation, standby is performed each time a sheet of paper is printed, and thus it is preferably used when printing cut paper such as A4 paper or B5 paper. On the other hand, in the embodiment described above, standby is performed for each dot formation process, and thus it can also be used when printing continuous paper such as roll paper.

It should be noted that because the standby time is long when standby is performed each time the printer prints a sheet of paper, the controller covers the head with a cap (not shown) during standby. By doing this, ink is prevented from evaporating from the nozzles and the hardening of ink within the nozzles is inhibited. It is also possible for the drive signal generator not to generate a non-ejection drive signal while the head is covered by the cap. However, it is desirable that idle ejection of ink from the head is performed after standby to eliminate clogged ink.

<Regarding the Standby Conditions>

In the foregoing embodiment the printer changed the standby time in increments (for example, from one second to three seconds). This is not a limitation, however.

Figure 18:
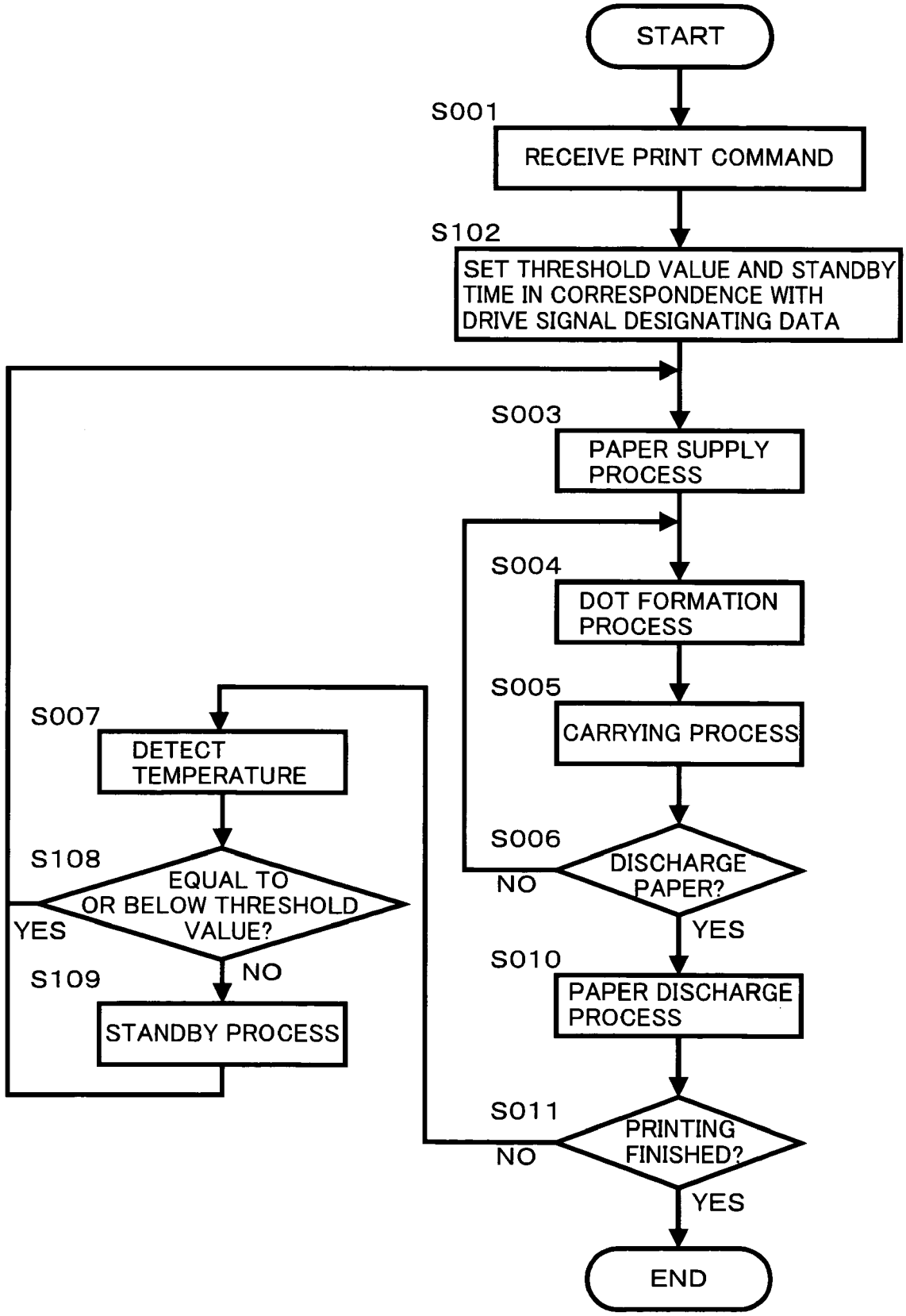
FIG. 18 is a flowchart of another embodiment.

FIG. 18 is a flowchart of another implementation. FIG. 19 is a table showing the relationship between the type of ejection drive signal and the threshold value and the standby time therefor.

The controller 60 receives a print command and then sets the threshold value and standby time according to the drive signal designating data in the print data (S102). For example, if the drive signal designating data designates the ejection drive signal COM1, then the controller sets the threshold value to 65° C. and the standby time to 60 seconds.

The controller 60 then detects the temperature each time a sheet of paper is printed (S007). If the temperature that is detected does not exceed the threshold value that has been set (YES in S108), then standby is not performed. On the other hand, if the temperature that is detected does exceed the threshold value that has been set (NO in S108), then standby is performed for the standby time that has been set (S109).

In this way as well, it is possible to perform standby based on the type of the ejection drive signal COM.

It should be noted that in this embodiment, both the threshold value and the standby time are set, but this is not a limitation. For example, it is also possible to set only the threshold value for each type of ejection drive signal COM and for each to have the same standby time.

<Regarding the Printer>

In the embodiment described above, a printer was described as the liquid ejecting apparatus; however, the liquid ejecting apparatus is not limited to this. For example, the same technology as that of the present embodiment can also be adopted for various types of liquid ejecting apparatuses that employ inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, methods therefor and manufacturing methods thereof are within the scope of application.

<Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, processing liquid, and genetic solutions. A reduction in material, process steps, and costs can be achieved if such liquids are directly ejected toward a target object.

<Regarding the Nozzles>

In the foregoing embodiment, ink was ejected using piezoelectric elements. However, the method for ejecting liquid is not limited to this. Other methods, such as a method for generating bubbles in the nozzles through heat, may also be employed.

===In Summary ===

(1) The printer (liquid ejecting apparatus) described above drives piezo elements to eject ink (liquid) onto paper (medium). The printer is provided with a drive signal generator 641 that generates ejection drive signals COM for driving the piezo elements, and a temperature sensor 55 for detecting the temperature of the drive signal generator 641.

The drive signal generator 641 is configured to generate three types of ejection drive signals COM1 to COM3.

In a case where the drive signal generator generates a plurality of types of ejection drive signals, then the power consumption differs depending on the type of the ejection drive signal. Thus, when the printer performs standby in the same manner irrespective of the type of the ejection drive signal, there is a drop in the printing speed. For example, when the printer performs standby based on the standby conditions for the ejection drive signal COM1, for which power consumption is high, when printing using the ejection drive signal COM2, then standby is performed even when the junction temperature Tj is low, thus lowering the printing speed per sheet of paper.

On the other hand, employing components to keep the printing speed from dropping increases costs. For example, a transistor that breaks down at 125° C. was employed in the embodiment described above, but using a transistor that can withstand temperatures up to 200° C. leads to an increase in costs.

Accordingly, the printer described above temporarily halts the generation of the ejection drive signals COM from the drive signal generator 641 based on the type of the ejection drive signal COM and the results of detection by the temperature sensor 55. By doing this, it is possible to provide a printer that is inexpensive and has fast printing speeds.

(2) The power consumed by the drive signal generator 641 is different for the three types of ejection drive signals COM1 to COM3 discussed above. For example, the power consumption for the ejection drive signal COM1 is 10 W, the power consumption for the ejection drive signal COM2 is 7 W, and the power consumption for the ejection drive signal COM3 is 4 W.

The ejection drive signal COM1, for which power consumption is large, is suited for forming large dots. In the present embodiment, the ejection drive signal COM1 is used when printing at a resolution of 360 dpi. The ejection drive signal COM1 is used in a case where the print medium is normal paper. On the other hand, the ejection drive signal COM3, for which power consumption is small, is suited for forming small dots. In the present embodiment, the ejection drive signal COM3 is used when printing at a resolution of 1440 dpi. The ejection drive signal COM3 is used in a case where the print medium is dedicated paper.

When printing normal paper, pixels are often filled in by large dots (pixel data "11"). Thus, printing normal paper using the ejection drive signal COM1 requires an even greater amount of power. On the other hand, when printing dedicated paper, small dots (print data "01") are ejected more frequently than large dots. Thus, power consumption is lower when printing dedicated paper using the ejection drive signal COM3.

In this way, if the foregoing embodiment can be achieved on a printer that is configured to generate a plurality of types of ejection drive signals COM1 to COM3 each having different power requirements, then it is possible to provide an inexpensive printer that has a fast printing speed.

(3) The voltages of the three types of ejection drive signals COM1 to COM3 mentioned above are different. For example, the ejection drive signal COM1 is 30V and the ejection drive signal COM2 is 28V. Thus, the power consumed by the drive signal generator is different.

(4) The waveforms of the three types of ejection drive signals COM1 to COM3 mentioned above are different. For example, the ejection drive signal COM3 has one less waveform than the ejection drive signal COM1. Thus, the power consumed by the drive signal generator is different.

(5) The printer described above repeatedly performs a dot formation process (ejection process) of ejecting ink and a carrying process of carrying paper. The printer performing the processing of FIG. 11 performs standby for each dot formation process performed in repetition.

Thus, the heat of the transistors of the drive signal generator 641 can be discharged per each dot formation process.

(6) When printing roll paper (continuous paper), it is preferable that standby is performed for each dot formation process. This is because performing standby for each sheet of paper that is printed as in FIG. 16 is not favorable because the number of dot formation processes that are performed differs depending on the length of the printed image (length in the carrying direction).

(7) The printer discussed above ejects ink in a continuous manner onto a plurality of sheets of paper. The printer, when carrying out the processing of FIG. 16, performs standby each time a sheet of paper is printed. By performing standby in this manner, the standby time does not change while printing on the same sheet of paper. The ink thus dries in the same way regardless of the print region, and therefore the quality of the printed image is improved.

(8) When printing cut paper, it is desirable that standby is performed each time a sheet of paper is printed. Further, because the length in the carrying direction changes depending on the paper size, the number of times that dot formation is performed changes. This gives rise to a change in the amount of heat that builds up during the printing of one sheet of paper, and thus the standby process may be changed depending on the type of the paper.

(9) With the printer described above, the standby time is determined in correspondence with the type of the ejection drive signal COM and the results of detection by the temperature sensor (see FIG. 12A to FIG. 12C). For example, if the detected temperature is 62° C., then the standby time for the ejection drive signal COM1 is three seconds, and the standby time for the ejection drive signal COM2 is zero seconds (standby is not performed). Thus, the printer can perform standby according to a standby time that corresponds to power requirements of the ejection drive signal.

(10) With the printer discussed above, the standby time is made longer for the type of ejection drive signal for which the power consumption of the drive signal generator is large. For example, the power consumption of the drive signal generator when generating the ejection drive signal COM1 is larger than that for the ejection drive signal COM2 or the ejection drive signal COM3. For that reason, a longer standby time is set for the ejection drive signal COM1 than for the ejection drive signal COM2 or the ejection drive signal COM3.

(11) With the printer discussed above, the standby time is made longer as the temperature detected by the temperature sensor increases. For example, with the ejection drive signal COM1, the standby time is one second if the detected temperature is equal to or more than 60° C. but less than 65° C., and the standby time is three seconds if the detected temperature is equal to or more than 65° C. but less than 70° C.

If the standby time when the detected temperature is equal to or more than 60° C. but less than 65° C. is set to three seconds, then a rise in the temperature of the drive signal generator could be inhibited, but the printing speed would become slow (see FIG. 14). Moreover, a detected temperature in the range of from 60° C. to 65° C. is not a temperature range at which the transistors will break down. Thus, it is favorable that within this range the printing speed is increased even at the expense of a rise in temperature.

Consequently, the foregoing embodiment allows an inexpensive printer that has a fast printing speed to be achieved.

(12) With the printer discussed above, the threshold value is determined in correspondence with the type of the ejection drive signal COM. Also, the printer discussed above performs standby when the result of the detection by the temperature sensor exceeds the threshold value.

For example, in the example of FIG. 12A, a threshold value of 60° C. has been chosen for the ejection drive signal COM1, and standby is performed when the results of temperature detection exceed 60° C. (see FIG. 11). Also, in the example of FIG. 19, a threshold value of 65° C. has been chosen for the ejection drive signal COM1, and standby is performed when the results of temperature detection exceed 65° C. (see FIG. 18).

By setting a threshold value that corresponds to the type of the ejection drive signal COM in this way, the temperature at which standby is begun differs depending on the type of the ejection drive signal COM. As a result, it is possible to perform standby based on the type of the ejection drive signal COM.

(13) With the above printer, the threshold value is set to a lower temperature for the type of ejection drive signal for which the power consumption of the drive signal generator is large. For example, in the example of FIG. 12A, the threshold value for the ejection drive signal COM1, for which power consumption is comparatively large, is set to 60° C., whereas the threshold value for the ejection drive signal COM2, for which power consumption is comparatively small, is set to 70° C.

At the same detection temperature Tp, a large power consumption will result in a higher junction temperature Tj than for a small power consumption ($Tj=R\theta jc\times P+Tp$). In other words, the transistor is more prone to breaking down if the power consumption of the transistor is large, even when the temperature detected by the temperature sensor 55 is the same.

Consequently, in the present implementation, the threshold value is set in correspondence with the junction temperature Tj.

(14) With the printer discussed above, generation of the ejection drive signal COM by the drive signal generator 641 is stopped, as a form of error, when the detection result of the temperature sensor has exceeded a critical value. In the above printer, the critical value is determined in correspondence with the type of the ejection drive signal COM.

For example, the printer sets the critical value to 70° C. for the ejection drive signal COM1 and sets the critical value to 80° C. for the ejection drive signal COM2.

In this way, if the ejection drive signal is COM2, then printing is continued until the temperature detected by the temperature detection sensor 55 becomes 80° C. For that reason, the number of sheets of paper that can be printed consecutively is greater than in a case where printing is stopped at 70° C., which is the same as the critical value of COM1.

(15) The drive signal generator 641 described above is capable of generating a non-ejection drive signal for driving the piezoelectric elements such that ink (liquid) is not ejected. Also, the drive signal generator 641 generates the non-ejection drive signal when temporarily halting generation of the ejection drive signal COM.

The ink within the chamber is thus agitated, and therefore hardening of the ink within the nozzles can be inhibited.

This is not a limitation, however. It is also possible for the drive signal generator 641 to temporarily halt generation of the non-ejection drive signal when temporarily halting generation of the ejection drive signal COM. In this case, it is preferable that the head is covered by a cap or the like to inhibit the evaporation of ink within the nozzles.

It is also possible for the drive signal generator 641 not to generate a non-ejection drive signal.

(16) The drive signal generator discussed above has transistors. When the drive signal generator generates an ejection drive signal COM, the transistors produce heat. However, this is not a limitation. It is also possible for a component other than the transistors to produce heat.

(17) The temperature sensor 55 discussed above detects the temperature at a location that is different from the transistors (heat-producing section) of the drive signal generator (see FIG. 10). That is, the temperature sensor 55 discussed above does not measure the junction temperature Tj directly.

For that reason, the relationship between the junction temperature Tj and the temperature detected by the temperature sensor 55 is $Tj=R\theta jc\times P+Tp$. That is, even if the temperature that is detected by the temperature sensor 55 is the same, the junction temperature Tj increases in accordance with the increase in the power consumption P of the ejection drive signal COM, and this increases the likelihood that the transistors will break down.

In other words, performing standby in accordance with the type of the ejection drive signal COM is beneficial for a structure where the temperature sensor 55 cannot directly detect the temperature of the heat-producing section.

What is claimed is:

1. A liquid ejecting apparatus that drives an element to eject a liquid onto a medium, comprising:

a drive signal generator that is configured to generate a plurality of types of ejection drive signals for driving said element to eject said liquid;

a sensor for detecting a temperature of said drive signal generator; and a controller that temporarily halts generation of the ejection drive signal from said drive signal generator based on the type of said ejection drive signal and a result of detection by said sensor.

2. A liquid ejecting apparatus according to claim 1, wherein power consumption of said drive signal generator is different for each type of said plurality of types of said ejection drive signals.

3. A liquid ejecting apparatus according to claim 2, wherein each type of said plurality of types of said ejection drive signals has a different voltage.

4. A liquid ejecting apparatus according to claim 2, wherein each type of said plurality of types of said ejection drive signals has a different waveform.

5. A liquid ejecting apparatus according to claim 1, wherein said liquid ejecting apparatus repeatedly performs an ejection process of ejecting said liquid and a carrying process of carrying said medium; and wherein for each said ejection process that is performed repeatedly, the generation of said ejection drive signal from said drive signal generator is temporarily halted based on the type of said ejection drive signal and the result of detection by said sensor.

6. A liquid ejecting apparatus according to claim 5, wherein said medium is continuous paper.

7. A liquid ejecting apparatus according to claim 1, wherein said liquid ejecting apparatus ejects said liquid consecutively onto a plurality of pieces of said medium; and wherein for each said medium, the generation of said ejection drive signal from said drive signal generator is temporarily halted based on the type of said ejection drive signal and the result of detection by said sensor.

8. A liquid ejecting apparatus according to claim 7, wherein said medium is cut paper.

9. A liquid ejecting apparatus according to claim 1, wherein a standby time for which the generation of said ejection drive signal from said drive signal generator is temporarily halted is determined in accordance with the type of said ejection drive signal and the result of detection by said sensor.

10. A liquid ejecting apparatus according to claim 9, wherein said standby time is made longer for the type of said ejection drive signal for which the power consumption of said drive signal generator is larger.

11. A liquid ejecting apparatus according to claim 9, wherein said standby time is made longer the higher the temperature detected by said sensor is.

12. A liquid ejecting apparatus according to claim 1, wherein a threshold value is determined in correspondence with the type of said ejection drive signal; and wherein when the result of detection by said sensor exceeds said threshold value, the generation of said ejection drive signal from said drive signal generator is temporarily halted.

13. A liquid ejecting apparatus according to claim 12, wherein said threshold value is set to a lower temperature for the type of said ejection drive signal for which the power consumption of said drive signal generator is larger.

14. A liquid ejecting apparatus according to claim 1, wherein said liquid ejecting apparatus stops the generation of said ejection drive signal from said drive signal generator when the result of detection by said sensor exceeds a critical value; and wherein said critical value is determined in correspondence with the type of said ejection drive signal.

15. A liquid ejecting apparatus according to claim 1, wherein said drive signal generator is configured to generate a non-ejection drive signal for driving said element such that said liquid is not ejected; and wherein said drive signal generator generates said non-ejection drive signal when temporarily halting the generation of said ejection drive signal.

16. A liquid ejecting apparatus according to claim 1, wherein said drive signal generator has a transistor; and wherein said transistor produces heat when said drive signal generator generates said ejection drive signal.

17. A liquid ejecting apparatus according to claim 1, wherein said sensor detects a temperature of a position that is different from a heat-producing section of said drive signal generator.

18. A liquid ejecting apparatus that drives an element to eject a liquid onto a medium, comprising:

a drive signal generator that is configured to generate a plurality of types of ejection drive signals for driving said element to eject said liquid;

a sensor for detecting a temperature of said drive signal generator; and a controller that temporarily halts generation of the ejection drive signal from said drive signal generator based on the type of said ejection drive signal and a result of detection by said sensor;

wherein power consumption of said drive signal generator is different for each type of said plurality of types of said ejection drive signals;

wherein each type of said plurality of types of said ejection drive signals has a different voltage;

wherein each type of said plurality of types of said ejection drive signals has a different waveform;

wherein said liquid ejecting apparatus repeatedly performs an ejection process of ejecting said liquid and a carrying process of carrying said medium, and for each said ejection process that is performed repeatedly, the generation of said ejection drive signal from said drive signal generator is temporarily halted based on the type of said ejection drive signal and the result of detection by said sensor;

wherein said medium is continuous paper;

wherein a standby time for which the generation of said ejection drive signal from said drive signal generator is temporarily halted is determined in accordance with the type of said ejection drive signal and the result of detection by said sensor;

wherein said standby time is made longer for the type of said ejection drive signal for which the power consumption of said drive signal generator is larger;

wherein said standby time is made longer the higher the temperature detected by said sensor is;

wherein a threshold value is determined in correspondence with the type of said ejection drive signal, and when the result of detection by said sensor exceeds said threshold value, the generation of said ejection drive signal from said drive signal generator is temporarily halted;

wherein said threshold value is set to a lower temperature for the type of said ejection drive signal for which the power consumption of said drive signal generator is larger;

wherein said liquid ejecting apparatus stops the generation of said ejection drive signal from said drive signal generator when the result of detection by said sensor exceeds a critical value;

wherein said critical value is determined in correspondence with the type of said ejection drive signal;

wherein said drive signal generator is configured to generate a non-ejection drive signal for driving said element such that said liquid is not ejected;

wherein said drive signal generator generates said non-ejection drive signal when temporarily halting the generation of said ejection drive signal;

wherein said drive signal generator has a transistor;

wherein said transistor produces heat when said drive signal generator generates said ejection drive signal; and wherein said sensor detects a temperature of a position that is different from a heat-producing section of said drive signal generator.

19. A liquid ejection method comprising:

generating one of a plurality of types of ejection drive signals from a drive signal generator to make a liquid be ejected in correspondence with that ejection drive signal;

detecting a temperature of said drive signal generator; and temporarily halting generation of said ejection drive signal from said drive signal generator based on the type of said ejection drive signal and the temperature of said drive signal generator.

20. A printing system comprising:

a computer; and a printing apparatus that drives an element to eject an ink onto paper, and that is provided with:

a drive signal generator that is configured to generate a plurality of types of ejection drive signals for driving said element;

a sensor for detecting a temperature of said drive signal generator; and a controller that temporarily halts generation of the ejection drive signal from said drive signal generator based on the type of said ejection drive signal and a result of detection by said sensor.

* * * * *